US010227721B2

(12) United States Patent
Hatanaka et al.

(10) Patent No.: US 10,227,721 B2
(45) Date of Patent: Mar. 12, 2019

(54) WOVEN MATERIALS AND METHODS OF FORMING WOVEN MATERIALS

(71) Applicant: Apple Inc., Cupertino, CA (US)

(72) Inventors: Motohide Hatanaka, Tokyo-to (JP); Ying-Liang Su, Shenzhen (CN); Yoji Hamada, Tokyo-to (JP)

(73) Assignee: APPLE INC., Cupertino, CA (US)

( * ) Notice: Subject to any disclaimer, the term of this patent is extended or adjusted under 35 U.S.C. 154(b) by 263 days.

(21) Appl. No.: 14/790,123

(22) Filed: Jul. 2, 2015

(65) Prior Publication Data

US 2016/0258084 A1 Sep. 8, 2016

Related U.S. Application Data

(60) Provisional application No. 62/129,679, filed on Mar. 6, 2015.

(51) Int. Cl.

| | |
|---|---|
| ***D03D 13/00*** | (2006.01) |
| ***D06C 7/00*** | (2006.01) |
| ***D03D 3/00*** | (2006.01) |
| ***D03D 11/02*** | (2006.01) |

(52) U.S. Cl.
CPC ..... *D06C 7/00* (2013.01); *D03D 3/005* (2013.01); *D03D 11/02* (2013.01); *D03D 13/00* (2013.01); *D03D 13/004* (2013.01)

(58) Field of Classification Search
CPC ..... D03D 13/00
See application file for complete search history.

(56) References Cited

U.S. PATENT DOCUMENTS

| | | | |
|---|---|---|---|
| 2,696,839 | A | 12/1954 | Schuerhoff |
| 3,362,595 | A | 1/1968 | Herzog |
| 3,885,383 | A | 5/1975 | Tanaka |
| 4,585,037 | A | 4/1986 | Kimbara |
| 4,662,407 | A | 5/1987 | Duncan |
| 4,748,078 | A | 5/1988 | Doi et al. |
| 4,846,230 | A | 7/1989 | Mock et al. |

(Continued)

FOREIGN PATENT DOCUMENTS

| | | |
|---|---|---|
| BE | 555150 | 2/1957 |
| CH | 335252 | 2/1959 |

(Continued)

*Primary Examiner* — Andrew T Piziali
(74) *Attorney, Agent, or Firm* — Morgan, Lewis & Bockius LLP

(57) ABSTRACT

Woven material and altering the weave pattern of the woven material. The woven material may comprise a first portion comprising a weave pattern formed by a plurality of warp threads and at least one weft thread woven between the plurality of warp threads. The first portion may have a first thickness. The woven material may also comprise a locally thinned portion positioned adjacent the first portion. The locally thinned portion may comprise an altered weave pattern, which may comprise the plurality of warp threads positioned on a single side of the at least one weft thread, and/or the at least one weft thread woven between the plurality of warp threads in the locally thinned portion is separated by a first distance. The first distance may be greater than a second distance positioned between the at least one weft thread woven between the plurality of warp threads in the first portion.

16 Claims, 20 Drawing Sheets

(56) References Cited

U.S. PATENT DOCUMENTS

| | | | | |
|---|---|---|---|---|
| 5,089,669 | A | 2/1992 | Piper et al. | |
| 5,219,636 | A | 6/1993 | Golz | |
| 5,437,314 | A | 8/1995 | Sainen | |
| 5,438,851 | A | 8/1995 | Geissbuhler | |
| 5,465,762 | A | 11/1995 | Farley | |
| 5,529,826 | A | 6/1996 | Tailor et al. | |
| 5,888,915 | A * | 3/1999 | Denton | D02G 3/447 139/383 A |
| 6,336,475 | B2 | 1/2002 | Dewispelaere et al. | |
| 6,376,047 | B1 | 4/2002 | Hasegawa | |
| 7,143,437 | B2 | 11/2006 | Royer et al. | |
| 7,275,667 | B2 | 10/2007 | Bertucci | |
| 7,473,336 | B2 * | 1/2009 | Hawes | D21F 1/0036 139/383 A |
| 7,836,917 | B1 | 11/2010 | Osborne | |
| 7,909,066 | B2 | 3/2011 | Wada | |
| 8,039,083 | B2 | 10/2011 | Higashinaka et al. | |
| 8,603,374 | B2 | 12/2013 | Domagalski et al. | |
| 8,651,150 | B2 | 2/2014 | Siebert | |
| 2006/0166577 | A1 | 7/2006 | Rashed | |
| 2013/0008554 | A1 | 1/2013 | Fisher et al. | |
| 2014/0135906 | A1 | 5/2014 | Winner et al. | |
| 2016/0037866 | A1 | 2/2016 | Rohrbach et al. | |

FOREIGN PATENT DOCUMENTS

| | | |
|---|---|---|
| CN | 201546014 | 8/2010 |
| CN | 203382963 | 1/2014 |
| CN | 203513965 | 4/2014 |
| EP | 0036527 | 3/1981 |
| FR | 1217530 | 5/1960 |
| JP | 2006130167 | 5/2006 |
| JP | 2012172281 | 9/2012 |
| WO | WO2009059209 | 5/2009 |

* cited by examiner

WOVEN MATERIALS AND METHODS OF FORMING WOVEN MATERIALS

CROSS-REFERENCE TO RELATED APPLICATION

This application is a nonprovisional patent application of and claims the benefit of U.S. Provisional Patent Application No. 62/129,679, filed Mar. 6, 2015 and titled "Woven Materials and Methods of Forming Woven Materials," the disclosure of which is hereby incorporated herein by reference in its entirety.

FIELD

The disclosure relates generally to woven materials, and more particularly to the woven material and altering the weave pattern of the woven materials to improve physical characteristics and/or visual and/or tactile features.

BACKGROUND

Conventional woven material or fabric is used in a plurality of applications or industries. For example, woven material is used in clothing/apparel (e.g., shirts, pants, skirts, etc.), in fashion accessories (e.g., bracelets, watch bands, necklaces, etc.), in electronics (e.g., woven conductive layers, protective outer sheaths for optical fiber cables), and other various industrial applications (e.g., rope, tape, protective gear, household/kitchenware, and so on). Due to the many uses and applications, conventional woven material is manufactured using specific material and/or manufactured to include specific physical properties. For example, where the woven material is used to form a bracelet or necklace, it may be desired that the woven material be flexible to contour around the surface in which the woven material is worn (e.g., wrist, neck) and be durable, flexible and/or capable of withstanding typical wear/treatment of a bracelet or necklace.

However, conventional woven material may be difficult to process and/or maintain a desired appearance while processing. For example, when pressing or melting conventional woven material, the material may expand, become discolored, and/or lose its uniform shape and appearance. From a visual and cosmetic viewpoint, this may be less than desirable when the conventional woven material is being utilized as a fashion accessory.

In addition, because of the construction and/or weave pattern, conventional woven material may be substantially stiff and/or immovable. Additionally, the conventional construction and/or weave pattern of the woven material may make accessing interior portions or layers of the woven material difficult, as thread of the woven material is woven tightly to avoid coming undone (e.g., unwoven). These shortcomings of conventional woven material make it difficult to utilize the woven material in applications that require frequent flexing of the woven material and/or where an additional component may need to be positioned through and/or secured within the woven material.

SUMMARY

Generally, embodiments discussed herein are related to altering the weave pattern of woven materials to improve physical characteristics, and/or visual and/or tactile features of the material. The weave pattern of a woven material may be altered to provide a locally thinned portion in the woven material to improve the melting and pinching process performed on the woven material. Additionally, the locally thinned portion of the woven material may provide better cosmetic features and/or appearance of the melted/pinched woven material. Additionally, altering the weave pattern of the woven material may increase flexibility in the woven material and/or reduce stiffness. These changes in material characteristics (e.g., flexibility, stiffness) may be achieved locally or globally in the woven material, based on the amount of alteration achieved in the weave pattern of the woven material. Also, the weave pattern of the woven material may be altered to create a localized separation between the plurality of layers forming the woven material. This localized separation may allow components of the wearable band to be more easily inserted through and/or secured within the woven material used to form the wearable band of the electronic device. The altering of the weave pattern may be achieved by altering a weave pattern of the plurality of warp threads of the woven material, and/or at least one connection yarn woven through the woven material.

One embodiment may take the form of a woven material. The woven material may comprise a first portion comprising a weave pattern formed by a plurality of warp threads and at least one weft thread woven between the plurality of warp threads. The first portion may have a first thickness. The woven material may also comprise a locally thinned portion positioned adjacent the first portion. The locally thinned portion may comprise an altered weave pattern, which may comprise the plurality of warp threads positioned on a single side of the at least one weft thread, and/or the at least one weft thread woven between the plurality of warp threads in the locally thinned portion is separated by a first distance. The first distance may be greater than a second distance positioned between the at least one weft thread woven between the plurality of warp threads in the first portion.

Another embodiment may take the form of a method of forming a wearable band from woven material. The method may comprise altering a weave pattern of the woven material comprising at least one weft thread, and a plurality of warp threads. The altering of the weave pattern may comprise positioning the plurality of warp threads on a single side of the at least one weft thread, and/or increasing the distance between the at least one weft thread woven between the plurality of warp threads. The method may also comprise creating a locally thinned portion in the woven material at the altered weave pattern.

A further embodiment may take the form of a woven material. The woven material may comprise a first layer of warp threads, the first layer forming a top surface, a second layer of warp threads positioned adjacent the first layer, a third layer of warp threads positioned adjacent the second layer, and a fourth layer of warp threads positioned adjacent the third layer. The fourth layer may form a bottom surface. The woven material may also comprise at least one weft thread positioned between the warp threads over a length of the first layer, the second layer, the third layer, and the fourth layer. The woven material may further comprise at least one set of connection yarns woven through the at least one weft thread positioned between at least two distinct layers of warp threads.

An additional embodiment may take the form of a wearable electronic device comprising a housing, and a wearable band formed from a woven material coupled to the housing. The woven material may comprise a first layer of warp threads, the first layer forming a top surface, a second layer of warp threads positioned adjacent the first layer, a third layer of warp threads positioned adjacent the second layer, and a fourth layer of warp threads positioned adjacent the third layer. The fourth layer may form a bottom surface. The woven material may also comprise at least one weft thread positioned between the warp threads over a length of the first layer, the second layer, the third layer, and the fourth layer. The woven material may further comprise a localized separation between two distinct layers of warp threads in a portion of the woven material.

Another embodiment may take the form of a method of forming a wearable band assembly formed from a woven material. The method may comprise altering a weave pattern in a portion of the woven material forming the wearable band assembly. The woven material may comprise four distinct layers of warp threads, and at least one weft thread woven through the warp threads for each of the four distinct layers. The method may also comprise forming a localized separation between two distinct layers of the four distinct layers of the woven material, the localized separation formed between the two distinct layers of the woven material for receiving a pin.

An additional embodiment may take the form of a woven material forming at least two distinct wearable bands. The woven material may comprise four distinct layers of a plurality of warp threads, and at least one weft thread positioned between the four distinct layers of the plurality of warp threads. The at least one weft thread may be woven through each of the four distinct layers of the plurality of warp threads twice between the plurality of warp thread alternating between being positioned above or below the at least one weft thread. The woven material may also comprise four distinct connection yarns woven through the at least one weft thread positioned between the plurality of warp threads, and a localized separation formed between two distinct layers of the four distinct layers of the plurality of warp threads.

BRIEF DESCRIPTION OF THE DRAWINGS

The disclosure will be readily understood by the following detailed description in conjunction with the accompanying drawings, wherein like reference numerals designate like structural elements, and in which.

Figure 1:
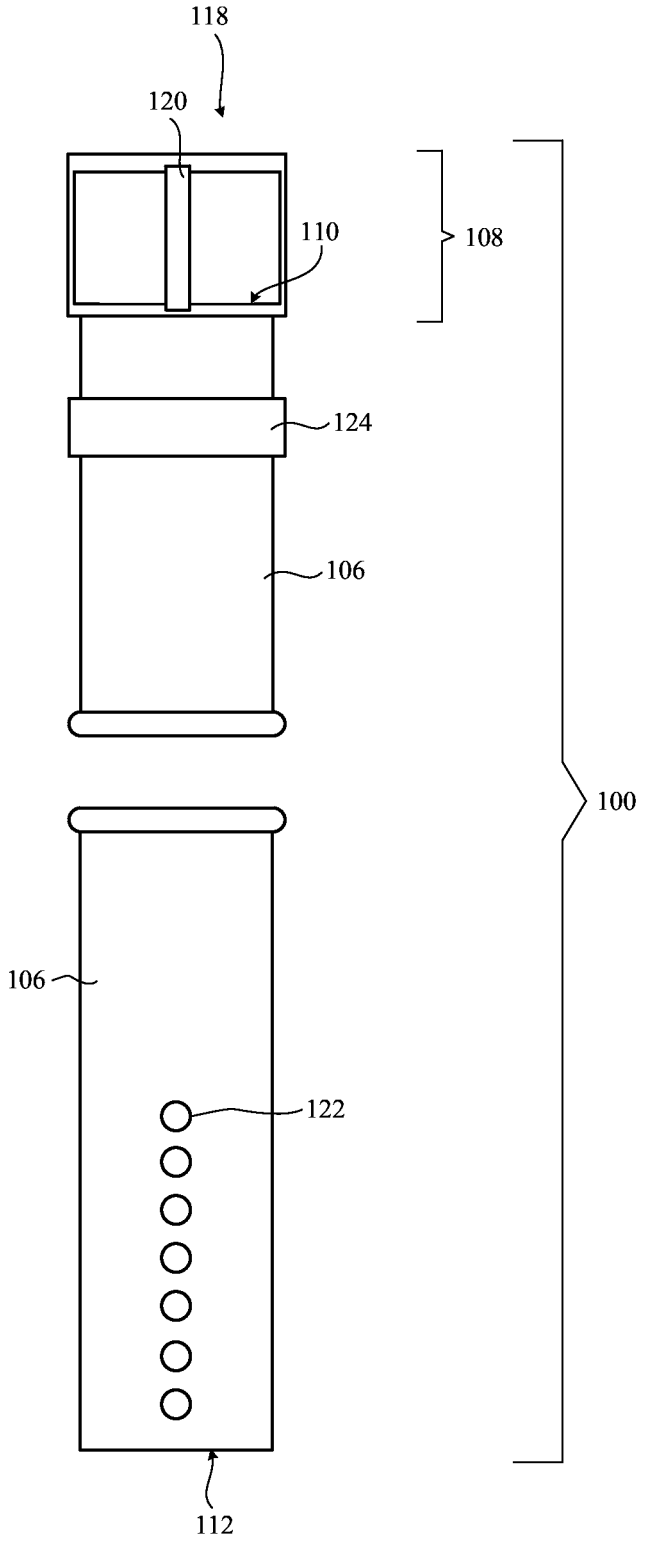
FIG. 1 depicts an illustrative top view of the wearable band for a wearable electronic device, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to woven materials, and more particularly to the woven material and altering the weave pattern of the woven materials to improve physical characteristics and/or visual and/or tactile features.

The weave pattern of a woven material may be altered to provide a locally thinned portion in the woven material to improve the melting and pinching process performed on the woven material. Additionally, the locally thinned portion of the woven material may provide better cosmetic features and/or appearance of the melted/pinched woven material. Additionally, altering the weave pattern of the woven material may increase flexibility in the woven material and/or reduce stiffness. These changes in material characteristics (e.g., flexibility, stiffness) may be achieved locally or globally in the woven material based on the amount of alteration achieved in the weave pattern of the woven material. Also, the weave pattern of the woven material may be altered to create a localized separation between the plurality of layers forming the woven material. This localized separation may allow components of the wearable band to be more easily inserted through and/or secured within the woven material used to form the wearable band of the electronic device. The altering of the weave pattern may be achieved by altering a weave pattern of the plurality of warp threads of the woven material, and/or at least one connection yarn woven through the woven material.

These and other embodiments are discussed below with reference to FIGS. 1-21. However, those skilled in the art will readily appreciate that the detailed description given herein with respect to these Figures is for explanatory purposes only and should not be construed as limiting.

FIG. 1 shows an illustrative front view of wearable band 100 including woven material 106, according to embodiments. In non-limiting examples, wearable band 100 may be a decorative band (e.g., wristband, armband, headband, necklace, etc.), a watch band, and a wearable band for holding or attaching to a housing of an electronic device including, but not limited to: a smartphone, a gaming device, a display, a digital music player, a wearable computing device or display, a health monitoring device or other suitable electronic device. In a non-limiting example shown in FIG. 1, wearable band 100 may form a watch band that may be coupled to a housing of the wearable electronic device (e.g., watch).

Wearable band 100 may include connection device 108 positioned at a first end 110 of wearable band 100. Connection device 108 may be formed within wearable band 100 to couple ends 110, 112 and/or secure wearable band 100 to a user. Connection device 108 may be any suitable coupling mechanism or embodiment capable of releasably coupling ends 110, 112 of wearable band 100. In a non-limiting example, as shown in FIG. 1, connection device 108 may include a buckle 118. First end 110 of wearable band 100 may include buckle 118 having a tongue 120 coupled to buckle 118. Buckle 118 may receive a portion of second end 112 of wearable band 100, and tongue 120 may be positioned within one of a plurality of holes 122 formed adjacent second end 112 to secure wearable band 100 to a user. The plurality of holes 122 formed through wearable band 100 may be formed using any suitable process including, but not limited to laser cutting, shearing or punching. Additionally, and as discussed herein, connection device 108 (e.g., buckle 118, tongue 120) may be coupled to woven material 106 forming wearable band 100 using a pin (see, e.g., FIG. 14) positioned through a portion of woven material 106.

Second end 112 may be further secured to wearable band 100 using retention loop 124 positioned substantially around wearable band 100. Retention loop 124 may form an opening (not shown) located between wearable band 100 and retention loop 124, where the opening may receive second end 112 and/or position second end 112 against a portion of wearable band 100.

Woven material 106 forming wearable band 100 may be formed from a large piece of woven material 106 that may be substantially cut or shaped to a desired size. In a non-limiting example, woven material 106 may be cut from a larger piece of woven material 106 to form wearable band 100 using a laser cutting process. The laser used in the laser cutting process may substantially cut the woven material 106 to a desired dimension of wearable band 100 from the larger piece of woven material. Additionally, the laser in the laser cutting process may simultaneously cauterize and/or round the edges of woven material 106 forming wearable band 100 to prevent fraying of woven material 106. Although discussed herein as being laser cut, it is understood that woven material 106 may undergo any suitable cutting or shearing process to form wearable band 100.

Additionally, the laser cutting process may also form woven material 106 to include second end 112 that may be secured to the remaining portion of wearable band 100 without altering the cosmetic appearance and/or geometry of woven material 106 and/or wearable band 100. That is second end 112 may be cut to include a specific geometry during the laser cutting process, such that when coupled or secured to wearable band 100 and/or retention loop 124, second end 112 is cosmetically and/or geometrically similar to the remaining portion of woven material 106. As discussed herein, the weave pattern, and ultimately the dimensions, of woven material 106 may be altered in areas of woven material 106 that may be cut when forming wearable band 100.

Although shown as two distinct portions, it is understood that wearable band 100 may be formed from a single piece of woven material 106. In one non-limiting example, the single piece of woven material 106 forming wearable band 100 may have elastic properties, such that the wearable band 100 may be a single, continuous loop of woven material 106 and may stretch around a user's wrist. In another non-limiting example, the single piece of woven material 106 forming wearable band 100 may have a loop positioned on end 110 that may receive end 112, and end 112 may be folded back onto and coupled to portions of wearable band 100 to secure wearable band 100 to a user's wrist. In this non-limiting example, end 112 inserted through the loop position on end 110 and/or at least a portion of wearable band 100 contacting end 112 may include any suitable coupling component or feature that may couple end 112 to wearable band 100 including, but not limited to, Velcro, magnets, clips and so on.

Additionally, although discussed herein as being formed from a large piece of woven material 106, it is understood that wearable band 100 may be formed by weaving threads to size. That is, and in a non-limiting example, wearable band 100 may not be cut from a larger piece of woven material 106, but rather woven material 106 may be woven to a desired size of wearable band 100, and may not undergo a cutting process, as discussed herein. However, in the non-limiting example where wearable band 100 is formed from woven material 106 woven to size, the ends of woven material 106 may undergo additional processes, for example crimping, to improve physical characteristics, and/or visual and/or tactile features.

When forming wearable band 100 from woven material 106, it may be desired to produce a cosmetically appealing wearable band 100. As discussed herein, wearable band 100 may be formed from a piece of woven material 106 that may be cut (e.g., laser cut) to a desired dimension. During the cutting process, a desired cosmetic appearance (e.g., uniform thickness, reduced thickness) for the ends of wearable band 100 may be achieved by reducing a thickness of a portion of woven material 106 that may be cut when forming wearable band 100.

Figure 2:
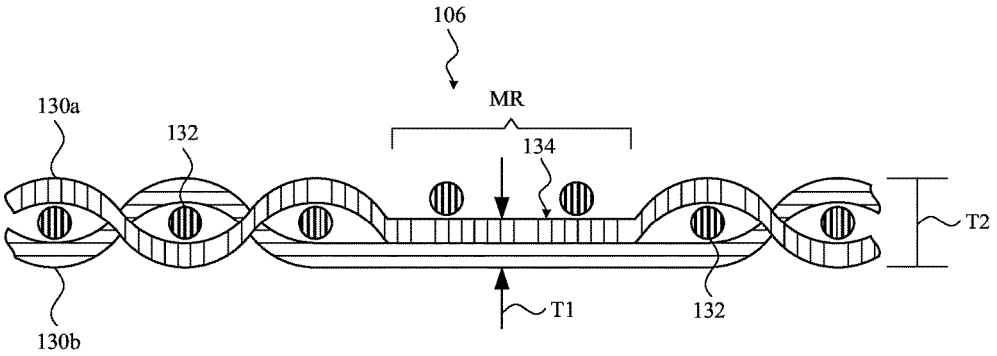
FIGS. 2 and 3 depict illustrative side cross-section views of a woven material having an altered weave pattern and a localized thinning, according to embodiments.

FIG. 2 shows a side cross-section view of a portion of woven material 106 used to form wearable band 100 of FIG. 1. Woven material 106 may be formed from a plurality of warp threads 130*a*, 130*b*, and at least one weft thread 132 coupled to the warp threads 130*a*, 130*b*. The plurality of warp threads 130*a*, 130*b* may be positioned or extend along a length of wearable band 100 (e.g., between first end 110 and second end 112), and at least one weft thread 132 positioned perpendicular to, and coupled to, woven or interlaced between the plurality of warp threads 130*a*, 130*b*. In the non-limiting example shown in FIG. 2, the plurality of warp threads 130*a*, 130*b* may continuously alternate position, and/or may alternate between being above and below weft thread 132 coupled to, woven or interlaced between the plurality of warp threads 130*a*, 130*b*. Woven material 106, as discussed herein, may be formed using any suitable weaving technique and/or weaving machinery. In a non-limiting example, woven material 106 may be formed using a dobby loom.

Warp threads 130*a*, 130*b* and the weft thread 132 may be formed from any suitable material capable of being coupled, woven or interlaced with each other to form woven material 106. In a non-limiting example, warp threads 130*a*, 130*b* and weft thread 132 of woven material 106 may be formed from or include a polyamide (e.g., nylon) material, a polyester material, thermoplastic polyethylene (e.g., Dyneema) or a polypropylene material. Warp threads 130*a*, 130*b* and weft thread 132 of woven material 106 may also be formed from any other suitable polymer material that may include similar physical characteristics as polyester and/or polypropylene. Warp threads 130*a*, 130*b* and weft thread 132 may be formed from the same material or may be formed from distinct materials when forming woven material 106.

It is understood that the number of threads shown in FIG. 2 to form woven material 106 may be merely exemplary, and may not represent the actual number of warp threads and/or weft threads used to form woven material 106. In a non-limiting example, woven material 106 may be formed from more than 200 warp threads and a single weft thread coupled to, woven or interlaced between the plurality of warp threads. In another non-limiting example, the at least one weft thread 132 may be formed from a single thread that may be continuously woven between warp threads 130*a*, 130*b*, or may be formed from a plurality of threads that may be woven between warp threads 130*a*, 130*b*. In conjunction, the spacing between the warp threads and/or weft threads as shown in FIG. 2 may also be merely exemplary for the purpose of clearly and completely describing woven material 106. It is understood that the space between the threads of woven material 106 may only be large enough to couple and/or weave at least one weft thread through the plurality of warp threads (e.g., 200 warp threads) to form woven material 106. Additionally, the spacing between the threads of woven material 106 may be substantially minimal such that a user may not be able to see through woven material 106.

As shown in FIG. 2, the weave pattern of woven material 106 may be modified and/or altered to produce a localized thinning and/or material-thickness reduction in a portion of woven material 106. The locally thinned portion 134 for woven material 106 may be achieved by altering the weave pattern, such that both warp threads 130*a*, 130*b* may be on a single side of weft thread 132. In the non-limiting example shown in FIG. 2, warp threads 130*a*, 130*b* may be positioned below weft thread 132 for a length of woven material 106 that includes two passes of weft thread 132 over warp threads 130*a*, 130*b*. The weave pattern of woven material 106 may resume and/or may continue after locally thinned portion 134 is formed in the portion of woven material 106.

The thickness (T1) of woven material 106 in the locally thinned portion 134 may be smaller than the thickness (T2) of the remaining portions of woven material 106. In the non-limiting example shown in FIG. 2, the altering of the weave pattern of woven material 106 to position both warp threads 130*a*, 130*b* below weft thread 132 may form the localized thinned portion 134 of woven material 106 having a thickness (T1) that may be less than the thickness (T2) of the portions of woven material 106 having weft thread 132 positioned between warp threads 130*a*, 130*b*, respectively.

The locally thinned portion 134 of woven material 106 may form and/or define a melt region (MR) in woven material 106. The melt region (MR) may include a portion of woven material 106 that may be melted and/or pinched to form a thinned portion of woven material 106 of wearable band 100 (see, FIG. 1). The reduced thickness in melt region (MR) may undergo a melting process (e.g., hot pressing) and/or a pinching process to produce a melted and thinned portion of woven material 106, that may subsequently form ends (e.g., first end 110, second end 112) for wearable band 100. By melting and pinching melt region (MR) having locally thinned portion 134, the melt region (MR) may have a reduced thickness when forming ends and/or may have a desirable cosmetic appearance by reducing fraying and/or preventing unwoven threads. As discussed herein with respect to FIG. 1, the end 112 of wearable band 100 may be inserted within retention loop 124 of wearable band 100. In another non-limiting example where melt region (MR) may also be embossed then laser cut, the thickness in melt region (MR) may slightly increase as a result of the melting of the threads during the embossing process. However, because of the reduced thickness (T1) of melt region (MR), the embossing and cutting process performed on melt region (MR) may result in the end of wearable band 100 having a uniform thickness with the remaining portion of wearable band 100.

Figure 3:
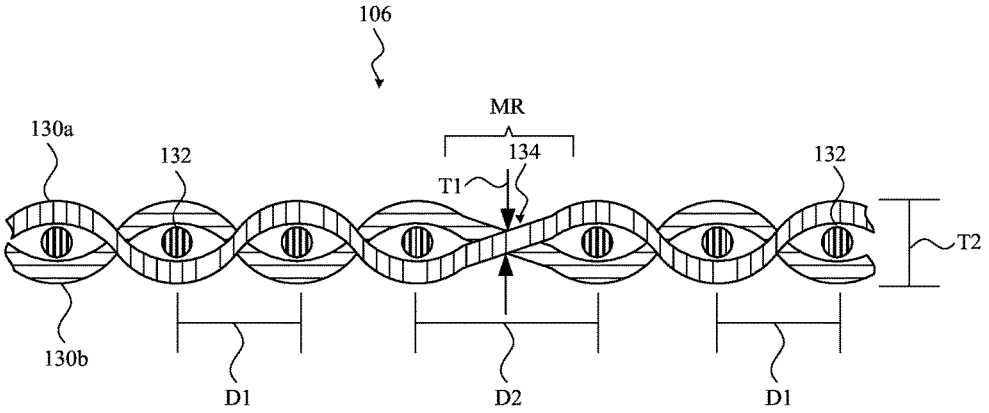

Woven material 106 also may form a locally thinned portion without substantially altering the weave pattern of warp threads 130*a*, 130*b*. For example, and as shown in FIG. 3, localized thinning and/or material thickness reduction of woven material 106 may be achieved by increasing the distance between weft thread 132. In the non-limiting example, the locally thinned portion 134 of woven material 106 forming melt region (MR) may be formed by increasing the distance between weft thread 132 as it is coupled to, woven or interlaced between the plurality of warp threads 130*a*, 130*b*. As shown in FIG. 3, the weave pattern for woven material 106 may include weft thread 132 being spaced or woven equal distant (D1) from itself as warp threads 130*a*, 130*b* alternate between positions (e.g., above weft thread, below weft thread). However, a portion of woven material 106 may include a localized thinning 134 by increasing the distance (D2) between two distinct passes of weft thread 132 as it is woven through warp threads 130*a*, 130*b*. As shown in FIG. 3, the weave pattern may not change the movement of warp threads 130*a*, 130*b* (e.g., above weft thread, below weft thread), however, the pitch of warp threads 130*a*, 130*b* may change due to the increase in the distance (D2) between distinct passes of weft thread 132.

As a result, the thickness (T1) in the locally thinned portion 134 of woven material 106, which includes weft threads 132 separated by the increased distance (D2), may be smaller than the thickness (T2) of the remaining portion of woven material 106, which includes weft threads 132 separated by equal distance (D1). Similar to FIG. 2, the non-limiting example shown in FIG. 3 may form a melt region (MR) within woven material 106 having a reduced thickness that may undergo melting processes for creating a desired cosmetic appearance for woven material forming wearable band 100 (see, FIG. 1). However, distinct from FIG. 2, the weave pattern, and specifically the alternating position of warp threads 130*a*, 130*b*, of woven material 106 may not be altered or modified when forming the locally thinned portion 134 and/or melt region (MR) in woven material 106. Rather only the distance between two distinct passes of weft thread 132 may be increased as it is woven through and/or positioned between warp threads 130*a*, 130*b*, as shown in FIG. 3.

It is understood that the size and/or length of melt region (MR) formed in woven material 106 shown in FIGS. 2 and 3 may be merely exemplary, and may not limit the size of the melt region (MR). In the non-limiting example shown in FIG. 2, warp threads 130*a*, 130*b* may be positioned underneath weft thread 132 for more or less than two passes of the weft thread 132 through woven material 106, which may result in an increase or decrease, respectively, in the size and/or length of melt region (MR). Additionally in the non-limiting example shown in FIG. 3, the distance (D2) between weft thread 132 may be increased to also increase the size and/or length of melt region (MR) formed in woven material 106.

Additionally, although shown only using two warp threads 130*a*, 130*b*, the altered weave pattern shown in FIGS. 2 and 3 to achieve a locally thinned portion 134 may be formed in woven material including more than two warp threads. Additionally, the altered weave pattern shown in FIGS. 2 and 3 may be formed in a woven material having a plurality of layers of warp threads, as discussed herein, to form locally thinned portion 134 and/or melt region (MR) in the multi-warp thread layer woven material.

Figure 4:
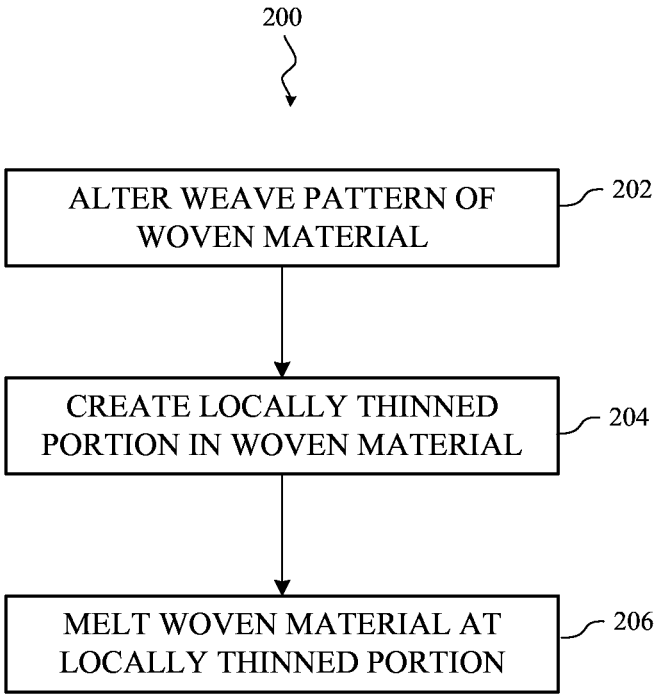
FIG. 4 depicts a flow chart of an example process for forming a wearable band assembly from a woven material, according to embodiments.

FIG. 4 depicts an example process for forming a wearable band for an electronic device. Specifically, FIG. 4 is a flowchart depicting one example process 200 for forming a wearable band from a woven material. In some cases, the process may be used to form the wearable band from woven material, as discussed above with respect to FIGS. 1-3.

In operation 202, a weave pattern of a woven material may be altered. The woven material may include at least one weft thread and a plurality of warp threads. In at least a portion of the woven material, the at least one weft thread may be coupled to, woven or interlaced between the plurality of warp threads. Additionally, each of the plurality of warp threads may alternate between being positioned above and below the weft thread, where at least one of the plurality of warp threads is positioned on an opposite side of the weft thread than a distinct warp thread. The altering of the weave pattern may further include positioning the plurality of warp threads on a single side of the at least one weft thread for a predetermined length of the woven material. In an additional non-limiting example, the altering of the weave pattern may further include increasing the distance between the at least one weft thread woven between the plurality of warp threads. The increase in the distance between the at least one weft thread may be over a predetermined length and/or number of passes of the weft thread within the woven material.

In operation 204, a locally thinned portion may be created in the woven material. The locally thinned portion of the woven material may be created in the portion of the woven material including the altered weave pattern. In a non-limiting example, the locally thinned portion may be formed in the predetermined length of woven material where the plurality of warp threads are positioned on the same side of the weft thread. In another non-limiting example, the locally thinned portion of the woven material may be formed in the predetermined length of the plurality of warp threads positioned between the at least one weft thread spaced an increased distance apart.

In operation 206, the woven material may be melted at the locally thinned portion. In a non-limiting example, the woven material may undergo a melting process to melt and fuse threads of the woven material. The woven material may be melted within the locally thinned portion of the woven material to improve cosmetic and visual effect of the end of the wearable band. Additionally, by melting the woven material in the locally thinned portion, the melting process of the woven material may be achieved more easily, as the thickness of the woven material is smaller than the thickness of portions of the woven material surrounding the locally thinned portion.

Figure 5:
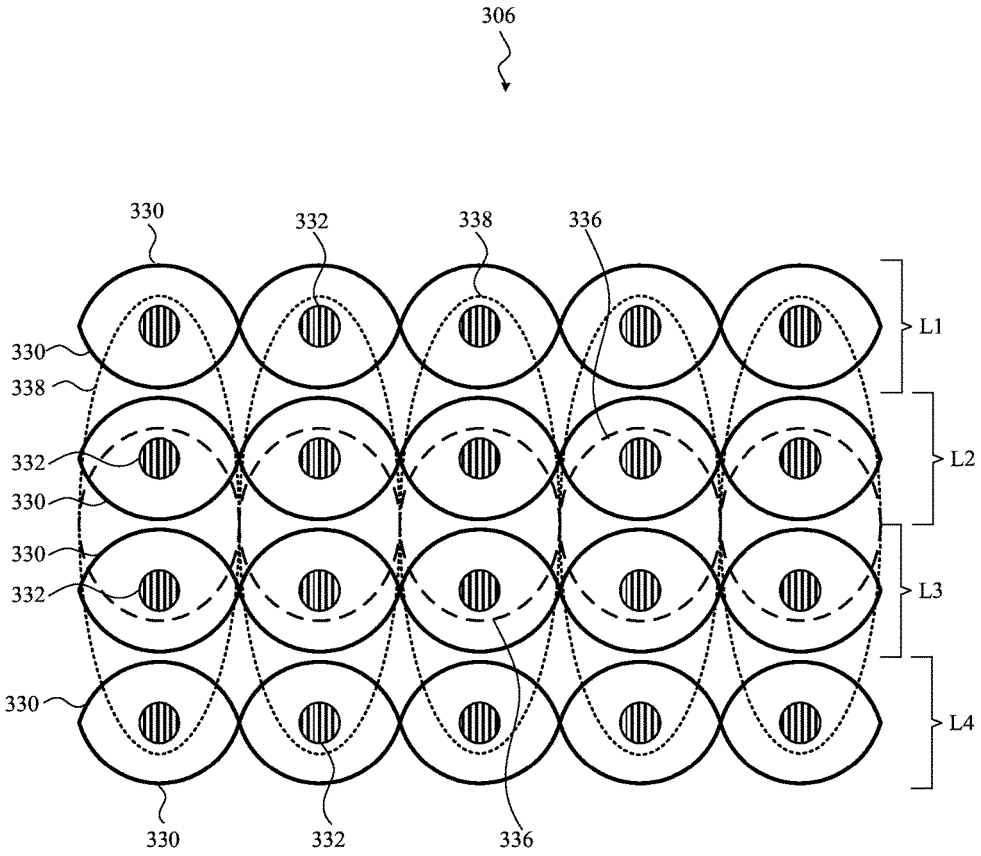
FIG. 5 depicts an illustrative side cross-section view of a woven material having four distinct layers of warp threads and at least one connection yarn, according to embodiments.

FIG. 5 shows a side cross-section view of a portion of another non-limiting example of woven material 306 used to form wearable band 100 of FIG. 1. As shown in FIG. 5, and similarly discussed herein with respect to FIG. 3, woven material 306 may include a plurality of warp threads 330 and at least one weft thread 332 positioned between warp threads 330, where warp threads 330 alternate between being positioned above and below weft thread 332. It is understood that similarly numbered and/or named components may function in a substantially similar fashion. Redundant explanation of these components has been omitted for clarity.

Woven material 306 may include a plurality of distinct layers of warp threads 330. In the non-limiting example shown in FIG. 5, woven material 306 may be formed from four distinct layers (L1-L4) of the plurality of warp threads 330. The first layer (L1) of the plurality of warp threads 330 may form a top surface of woven material 306. The second layer (L2) of warp threads 330 may be positioned adjacent the first layer (L1) of warp threads 330, and the third layer (L3) of warp threads may be positioned adjacent the second layer (L2). The second layer (L2) and third layer (L3) of warp threads 330 may collectively form the inner or interior layers of woven material 306. Additionally, the warp layers 330 of the second layer (L2) and the third layer (L3) may not be visible to a user of wearable band 100 (see, FIG. 1) formed from woven material 306. The fourth layer (L4) of warp threads 330 may be positioned adjacent the third layer (L3) of warp threads 330. The fourth layer (L4) of warp threads 330 may form a bottom surface of woven material 306, opposite the top surface formed by the first layer (L1).

At least one weft thread 332 may be positioned between the plurality of warp threads 330 in the first layer (L1), the second layer (L2), the third layer (L3) and the fourth layer (L4). In the non-limiting example shown in FIG. 5, weft thread 332 may be woven through and/or interlaced between all four layers of warp threads 330, over or across the entire length of woven material 306. Although single weft thread 332 is shown in FIG. 5, it is understood that a plurality of weft threads may be used when forming woven material 306. In a non-limiting example, each layer (L1-L4) of warp threads 330 may include an individual or distinct weft thread 332.

Woven material 306 may also include at least one set of connection yarns 336, 338. Each set of connection yarns 336, 338 may include at least two distinct yarns, and each yarn may be woven through weft thread 332 positioned between at least two distinct layers (L1-L4) of the plurality of warp threads 330. In a non-limiting example shown in FIG. 5, woven material 306 may include a first set of connection yarns 336, and a second set of connection yarns 338. In the non-limiting example of FIG. 5, first set of connection yarns 336 may be woven through weft thread 332 positioned between warp threads 330 of the second layer (L2) and the third layer (L3) for coupling, binding and/or securing warp threads 330 and/or weft threads 332 of the second layer (L2) to warp threads 330 and/or weft threads 332 formed in the third layer (L3). Additionally, second set of connection yarns 338 may be woven through weft threads 332 positioned between warp threads 330 of the first layer (L1) and the fourth layer (L4). Second set of connection yarns 338 may couple, bind and/or secure warp threads 330 and/or weft threads 332 of the first layer (L1) to warp threads 330 and/or weft threads 332 formed in the fourth layer (L4). In addition to coupling, binding and/or securing the various threads (e.g., warp threads 330, weft threads 332) and/or layers (L1-L4) of woven material 306 together, each set of connection yarns 336, 338 may provide additional support for maintaining a uniform thickness throughout woven material 306.

FIGS. 6-13 show additional, non-limiting examples of woven material 306. The additional, non-limiting examples of woven material 306 shown in FIGS. 6-13 may include some similar components and/or features of woven material 306 shown in FIG. 5, and some distinct features. The distinct features, discussed in detail below, may allow for increased flexibility in woven material 306, and ultimately, increased flexibility in wearable band 100 formed from woven material 306. The portion of woven material 306 depicted in FIGS. 6-13 may be a portion of the entire length of woven material 306, and may not necessarily represent the weave pattern of the entire length of woven material 306. As a result, woven material 306 of FIGS. 6-13 may be understood as depicting either a localized altered weave pattern formed in a portion of woven material 306, or an altered weave pattern formed in the entire length of woven material 306. In the non-limiting example where the weave pattern is altered in only a portion of woven material 306, the portion of woven material 306 having the altered weave pattern may include the improved physical features (e.g., increased flexibility) by comparison with the remaining portions of woven material 306.

Figure 6:
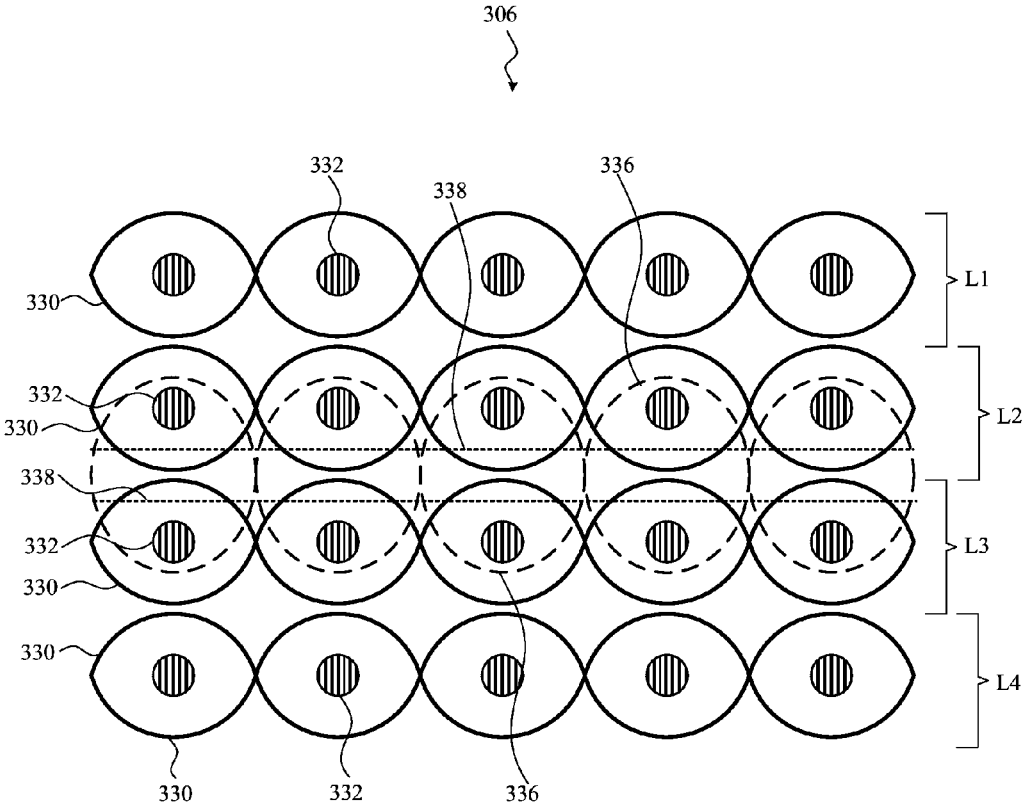
FIGS. 6-13 depict illustrative side cross-section view of the woven material having four distinct layers of warp threads and at least one connection yarn of FIG. 5 in altered weave patterns, according to further embodiments.

Turning to FIG. 6, the first set of connection yarns 336 may be woven through weft thread 332 positioned between warp threads 330 of the second layer (L2) and the third layer (L3), as similarly discussed herein with respect to FIG. 5. However, distinct from FIG. 5, the second set of connection yarns 338 may not be woven through any weft thread 332 and/or layers (L1-L4) of the plurality of warp threads 330 of woven material 306. Rather, in the non-limiting example shown in FIG. 6, the second set of connection yarns 338 may be positioned between, but not woven around, the plurality of warp threads 330 in the second layer (L2) and the third layer (L3). The second set of connection yarns 338 may also run along the length of the interior (e.g., not visible) of woven material 306. As a result of the positioning of the second set of connection yarns 338 with woven material 306 shown in FIG. 6, first layer (L1) and fourth layer (L4) of the plurality of warp threads 330 may only be secured to the remaining layers of woven material 306 using weft thread 332. As such, first layer (L1) and fourth layer (L4) of the plurality of warp threads 330 of woven material 306 may have increased flexibility and/or may be able to move without moving distinct layers (e.g., second layer (L2)) of woven material 306.

Additional portions of woven material 306 (not shown) may include additional features or components for coupling first layer (L1) and fourth layer (L4) of warp threads 330 to woven material 306. In a non-limiting example, portions of woven material 306 surrounding the portion shown in FIG. 6 may have the second set of connection yarns 338 woven in a similar pattern to that shown in FIG. 5, such that first layer (L1) and fourth layer (L4) of warp threads 330 are coupled to the remaining layers of woven material 306 using the second set of connection yarns 338. In another non-limiting example where the weave pattern depicted in FIG. 6 represents the weave pattern for the entire length of woven material 306, first layer (L1) and fourth layer (L4) of warp threads 330 may be coupled to the remaining layers of woven material 306 and the ends of woven material 306. A variety of features, components and/or techniques may be used to couple first layer (L1) and fourth layer (L4) of warp threads 330 to the remaining layers of woven material 306. For example, the layers of warp threads 330 in woven material 306 may be melted, crimped or embossed together at the ends of woven material 306. In an additional non-limiting example, connection yarns may be woven through first layer (L1) and fourth layer (L4) of warp threads 330, or all four layers (L1-L4) of warp threads 330 of woven material 306 to couple layers (L1-L4) to each other.

Figure 7:
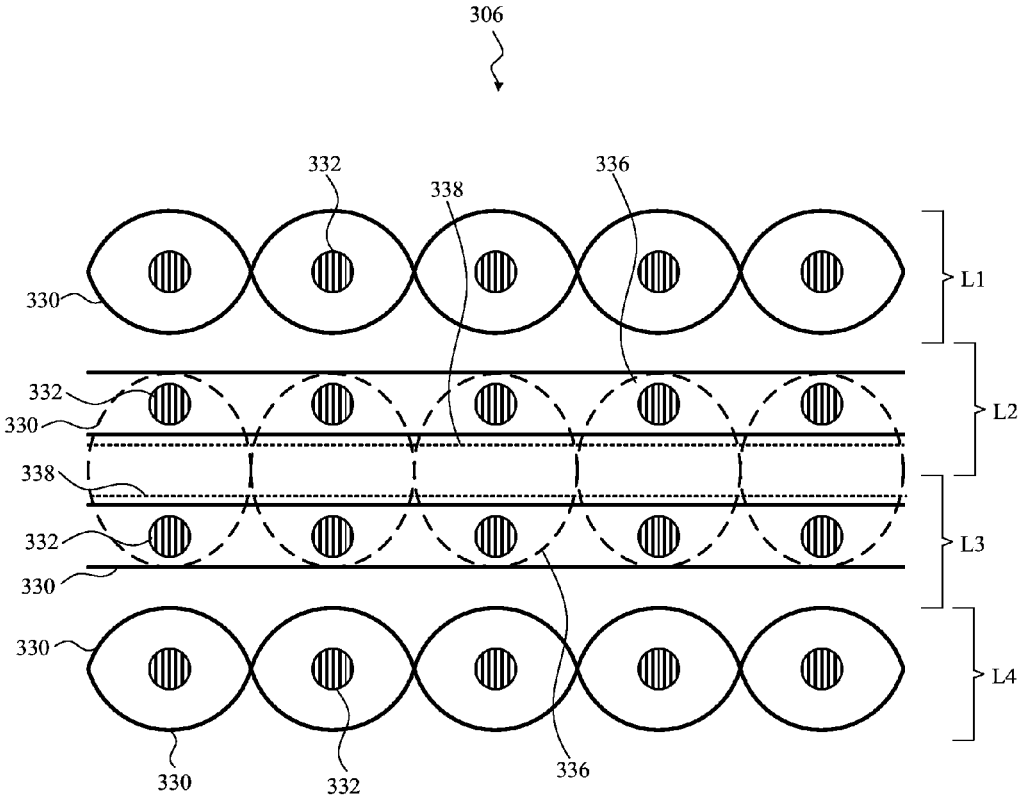

Similar to FIG. 6, in an additional non-limiting example shown in FIG. 7, the second set of connection yarns 338 may be positioned between, but not woven around, the plurality of warp threads 330 in the second layer (L2) and the third layer (L3). However, distinct from FIGS. 5 and 6, the plurality of warp threads 330 in second layer (L2) and third layer (L3) may not continuously alternate positions (e.g., above, below) with respect to weft thread 332 positioned within second layer (L2) and third layer (L3). Rather, as shown in FIG. 7, warp threads 330 of second layer (L2) and third layer (L3) may be parallel with the second set of connection yarns 338 and run along the length of woven material 306. A single thread of the plurality of warp threads 330 in each of the second layer (L2) and the third layer (L3) may be positioned above weft thread 332, and a distinct thread of warp threads 330 of the second layer (L2) and the third layer (L3) may be positioned above weft thread 332. As a result, weft thread 332 positioned in second layer (L2) and third layer (L3) may still be positioned between the plurality of warp threads 330 formed in second layer (L2) and third layer (L3), as shown in FIG. 7. In addition to increasing flexibility and movement in first layer (L1) and fourth layer (L4), as similarly discussed with respect to FIG. 6, the non-limiting example of woven material 306 shown in FIG. 7 may increase flexibility and/or reduced stiffness in second layer (L2) and third layer (L3) of warp threads 330, and ultimately, woven material 306.

Figure 8:
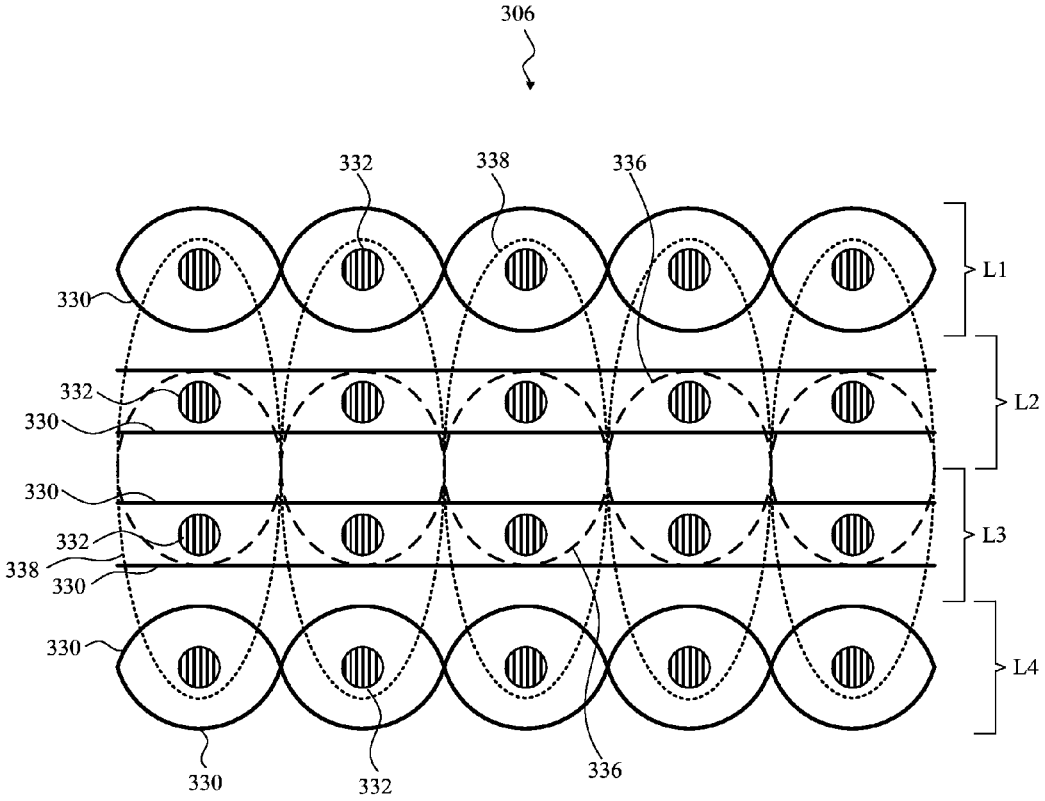

FIG. 8 shows another non-limiting example of woven material 306. In FIG. 8, first set of connection yarns 336 may be woven through weft thread 332 positioned between warp threads 330 of the second layer (L2) and the third layer (L3), and second set of connection yarns 338 may be woven through weft threads 332 positioned between warp threads 330 of the first layer (L1) and the fourth layer (L4). Additionally, and similar to woven material 306 shown in FIG. 7, the plurality of warp threads 330 in second layer (L2) and third layer (L3) may not continuously alternate positions (e.g., above, below) with respect to weft thread 332 positioned within second layer (L2) and third layer (L3), but may run parallel along a length of woven material 306. In the non-limiting example shown in FIG. 8, woven material 306 may have increased flexibility and/or reduced stiffness as a result of the weave pattern of warp threads 330 in second layer (L2) and third layer (L3). Woven material 306 of FIG. 8 may also maintain connection between all four layers (L1-L4) of woven material 306 using first set of connection yarns 336 (e.g., second layer (L2) and third layer (L3)) and second set of connection yarns 338 (e.g., first layer (L1) and fourth layer (L4)).

Figure 9:
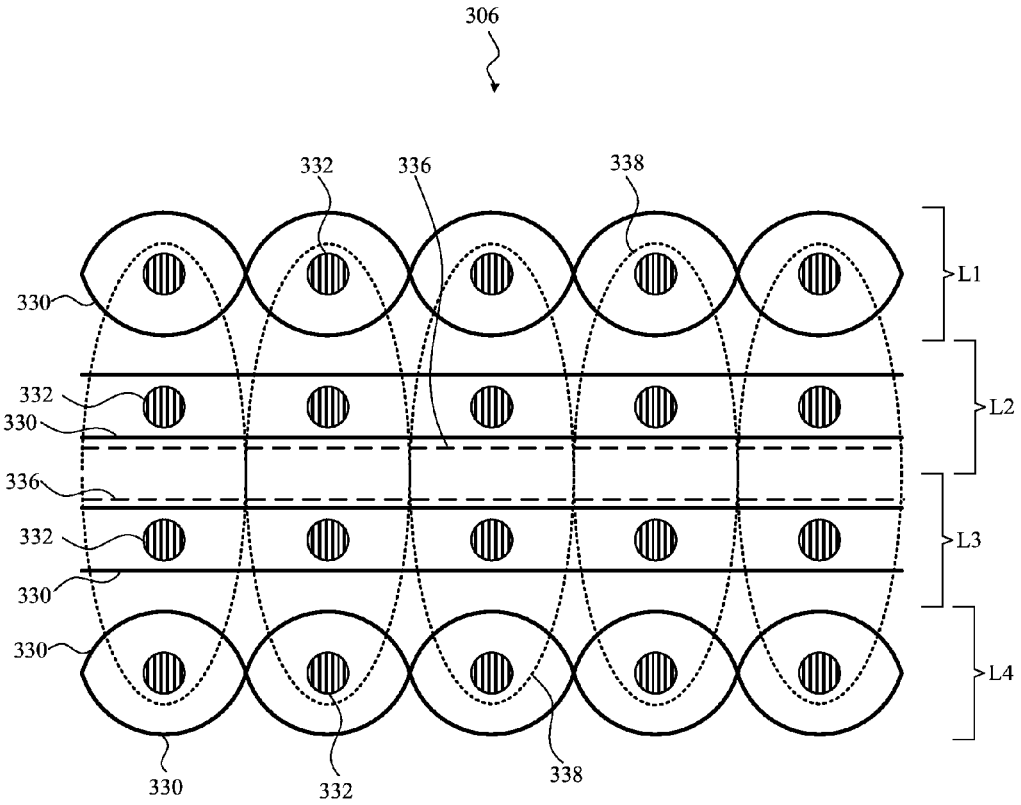

In the non-limiting example shown in FIG. 9, and similar to FIGS. 5 and 8, second set of connection yarns 338 may be woven through weft threads 332 positioned between warp threads 330 of the first layer (L1) and the fourth layer (L4). Second set of connection yarns 338 may couple, bind and/or secure warp threads 330 and/or weft threads 332 of the first layer (L1) to warp threads 330 and/or weft threads 332 formed in the fourth layer (L4). In conjunction, second set of connection yarns 338 may indirectly couple, bind and/or secure second layer (L2) and third layer (L3) of warp threads 330 within woven material 306 by sandwiching second layer (L2) and third layer (L3) between connected first layer (L1) and fourth layer (L4).

Additionally in the non-limiting example of FIG. 9, and similarly discussed with respect to FIGS. 7 and 8, the plurality of warp threads 330 in second layer (L2) and third layer (L3) may not continuously alternate positions (e.g., above, below) with respect to weft thread 332 positioned within second layer (L2) and third layer (L3), but may run parallel along a length of woven material 306. Distinct from the examples discussed herein, first set of connection yarns 336 may not be woven through any weft thread 332 and/or layers (L1-L4) of the plurality of warp threads 330 of woven material 306. Rather, in the non-limiting example shown in FIG. 9, the first set of connection yarns 336 may be positioned between, but not woven around, the plurality of warp threads 330 in the second layer (L2) and the third layer (L3). The first set of connection yarns 336 may also run along the length of the interior (e.g., not visible) of woven material 306. As a result of the unwoven pattern of the warp threads 330 in the second layer (L2) and third layer (L3), and the unwoven pattern of the first set of connection yarns 336, second layer (L2) and third layer (L3), and ultimately woven material 306 of FIG. 9, may have an increase in flexibility and/or a decrease in stiffness.

Figure 10:
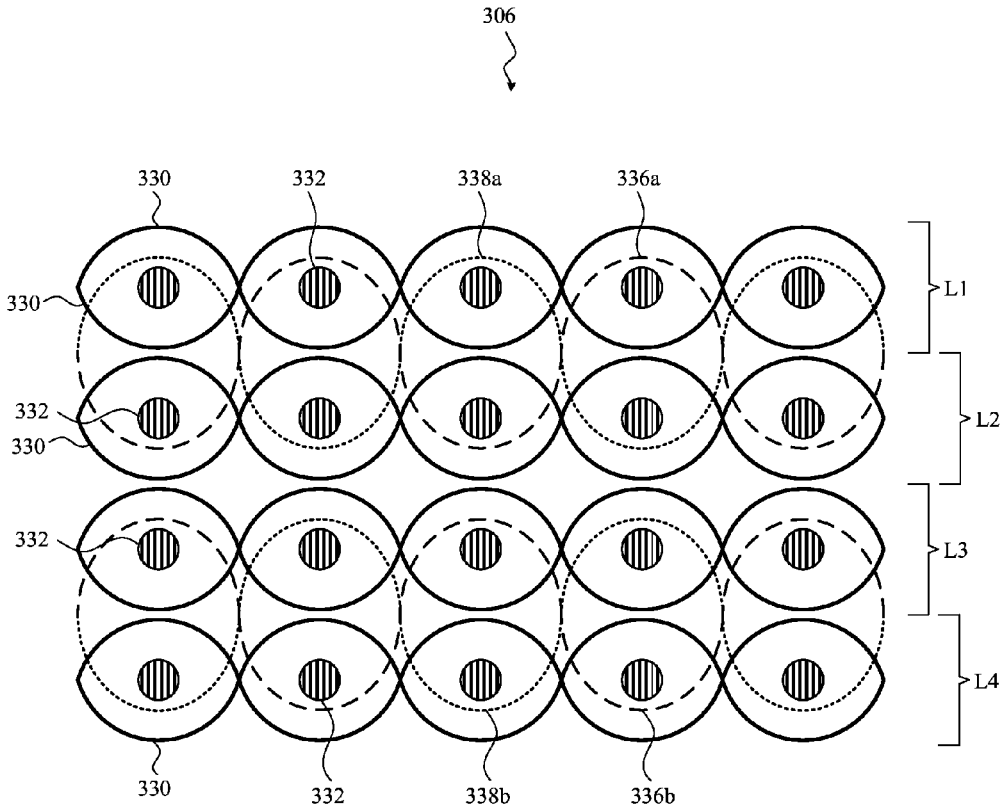
Figure 11:
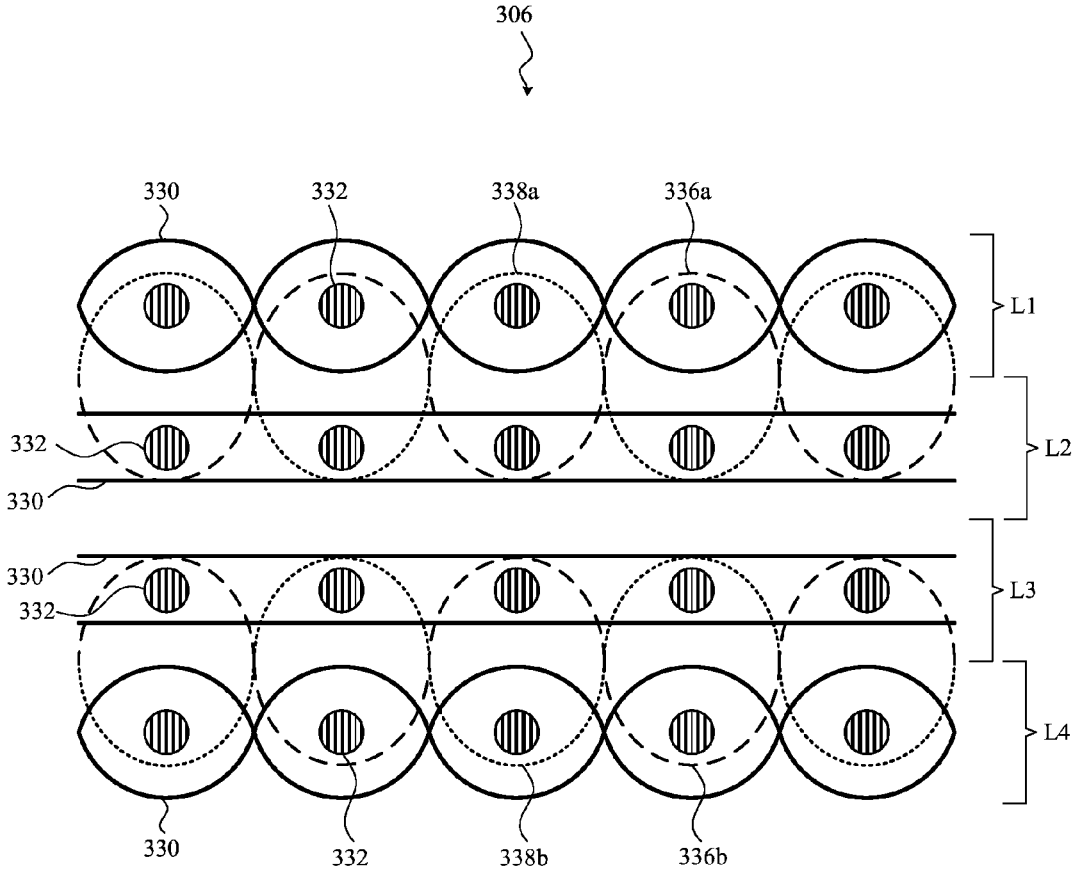

In additional non-limiting examples shown in FIGS. 10 and 11, individual or distinct yarn 336*a*, 336*b* of first set of connection yarns 336 and yarn 338*a*, 338*b* of second set of connection yarns 338 may be utilized together in coupling, binding or securing layers (L1-L4) of woven material 306 together. As shown in FIGS. 10 and 11, connection yarn 336*a* of first set of connection yarns 336 and connection yarn 338*a* of second set of connection yarns 338 may be woven through weft threads 332 positioned between warp threads 330 of the first layer (L1) and the second layer (L2). Connection yarns 336*a*, 338*a* of the first set of connection yarns 336 and the second set of connection yarns 338, respectively, may couple, bind and/or secure warp threads 330 and/or weft threads 332 of the first layer (L1) to warp threads 330 and/or weft threads 332 formed in the second layer (L2). Additionally shown in FIGS. 10 and 11, connection yarn 336*b* of first set of connection yarns 336 and connection yarn 338*b* of second set of connection yarns 338 may be woven through weft threads 332 positioned between warp threads 330 of the third layer (L3) and the fourth layer (L4) to couple, bind and/or secure warp threads 330 and/or weft threads 332 of the third layer (L3) and fourth layer (L4), respectively.

As a result of the coupling of first layer (L1) to second layer (L2) and third layer (L3) to fourth layer (L4), second layer (L2) and third layer (L3) may not be connected. As such, first layer (L1) and second layer (L2) may be free to move substantially independent of third layer (L3) and fourth layer (L4), which may increase flexibility and/or decrease stiffness in woven material 306. Additionally, and as discussed in detail herein, the coupling of first layer (L1) to second layer (L2) and third layer (L3) to fourth layer (L4) may increase penetrability between second layer (L2) and third layer (L3).

Distinct from FIG. 10, the plurality of warp threads 330 in second layer (L2) and third layer (L3) in FIG. 11 may not continuously alternate positions (e.g., above, below) with respect to weft thread 332 positioned within second layer (L2) and third layer (L3), but may run parallel along a length of woven material 306. As discussed herein, the weave pattern of warp threads 330 in second layer (L2) and third layer (L3) of woven material 306, as shown in FIG. 11, may provide further flexibility and/or reduce the stiffness in between second layer (L2) and third layer (L3), and ultimately woven material 306.

Figure 12:
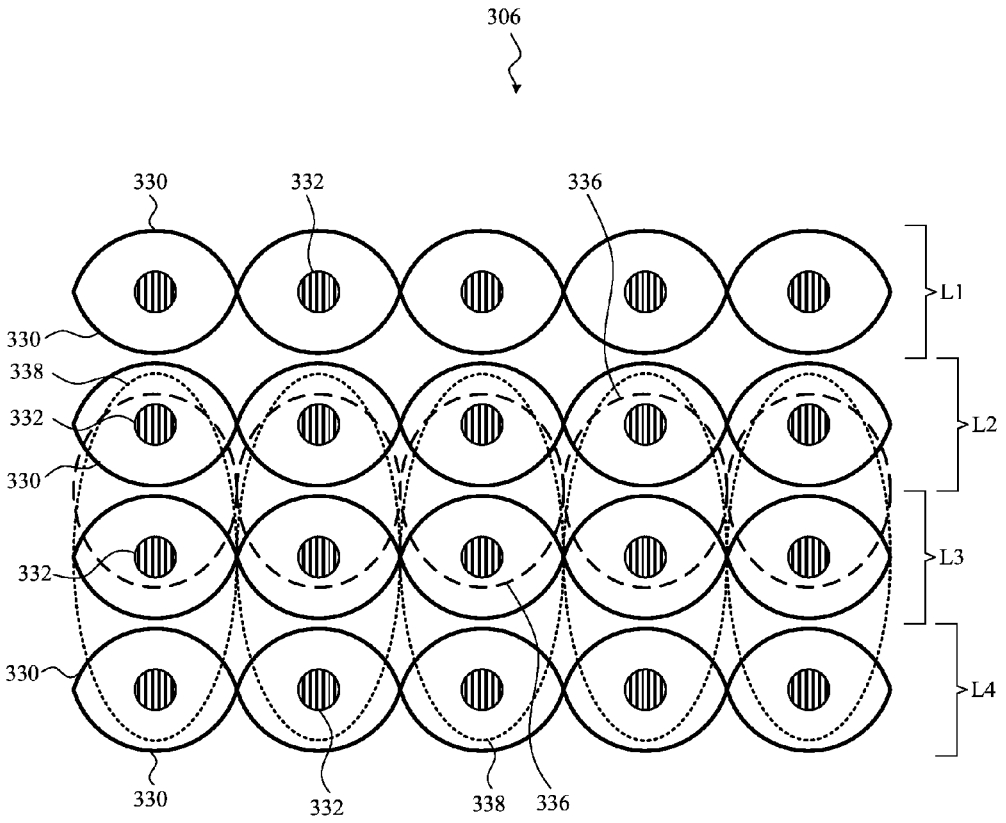
Figure 13:
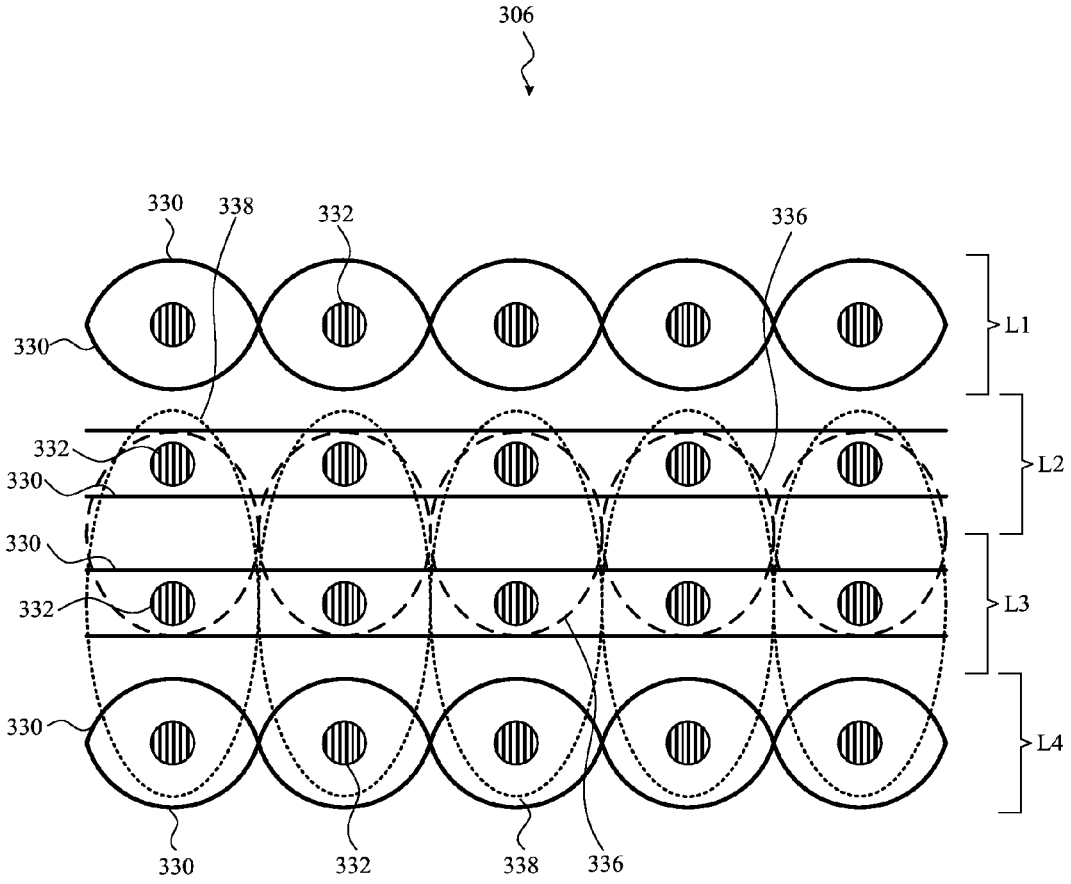

In further non-limiting examples shown in FIGS. 12 and 13, first set of connection yarns 336 may be woven through weft thread 332 positioned between warp threads 330 of second layer (L2) and third layer (L3) for coupling, binding and/or securing warp threads 330 and/or weft threads 332 of second layer (L2) to warp threads 330 and/or weft threads 332 formed in third layer (L3). Additionally, woven material 306 shown in FIGS. 12 and 13 may include second set of connection yarns woven through weft thread 332 positioned between warp threads 330 of the second layer (L2) and the fourth layer (L4). Second set of connection yarns 338 may couple, bind and/or secure warp threads 330 and/or weft threads 332 of second layer (L2) to warp threads 330 and/or weft threads 332 formed in fourth layer (L4), and may in turn secure third layer (L3) between second layer (L2) and fourth layer (L4). In the non-limiting examples shown in FIGS. 12 and 13, both first set of connection yarns 336 and second set of connection yarns 338 may be woven through weft threads 332 positioned between warp threads 330 of second layer (L2).

In the non-limiting example shown in FIGS. 12 and 13, first set of connection yarns 336 and second set of connection yarns 338 may not be woven through weft thread 332 positioned within first layer (L1). As a result, first layer (L1) of warp threads 330 in woven material 306 may be disconnected from the remaining layers (L2-L4) of woven material 306, and may be substantially free to move independent of second layer (L2), third layer (L3) and fourth layer (L4). In addition, by disconnecting first layer (L1) from the remaining layers (L2-L4) of woven material 306, woven material 306 may be able to bend acutely without buckling inner layers (L2-L3) of woven material 306. As such, first layer (L1) of woven material 306 may be oriented in a specific manner within wearable band 100 (see, FIG. 1), such that first layer (L1) may typically bend, flex or curve in a single direction, and the remaining layers, and specifically inner layers, of woven material 306 may not buckle and maintain shape or rigidity for wearable band 100.

Distinct from FIG. 12, the plurality of warp threads 330 in second layer (L2) and third layer (L3) in FIG. 13 may not continuously alternate positions (e.g., above, below) with respect to weft thread 332 positioned within second layer (L2) and third layer (L3), but may run parallel along a length of woven material 306. As discussed herein, the weave pattern of warp threads 330 in second layer (L2) and third layer (L3) of woven material 306, as shown in FIG. 13, may provide further flexibility and/or reduce the stiffness in between second layer (L2) and third layer (L3), and ultimately woven material 306.

Although discussed herein as increasing flexibility through woven material 306 and/or wearable band 100, it is understood that the distinct weave patterns of woven material 306 shown in FIGS. 6-13 may be locally formed within woven material 306. That is, the non-limiting example weave patterns for woven material 306, as shown in FIGS. 6-13, may only be formed in a portion of wearable band 100 formed from woven material 306. As such, only localized portions of wearable band 100 may include the benefits (e.g., increased flexibility, decreased stiffness, increased penetrability) discussed herein with respect to the non-limiting examples shown in FIGS. 6-13. These locally formed weave patterns, which increase flexibility, may be formed in portions of wearable band 100 that are typically subject to frequent and extensive bending. For example, a weave pattern of woven material 306 discussed herein with respect to FIGS. 6-13 may be formed in a portion of wearable band 100 adjacent the housing of the electronic device that may typically bend around a user's wrist.

Figure 14:
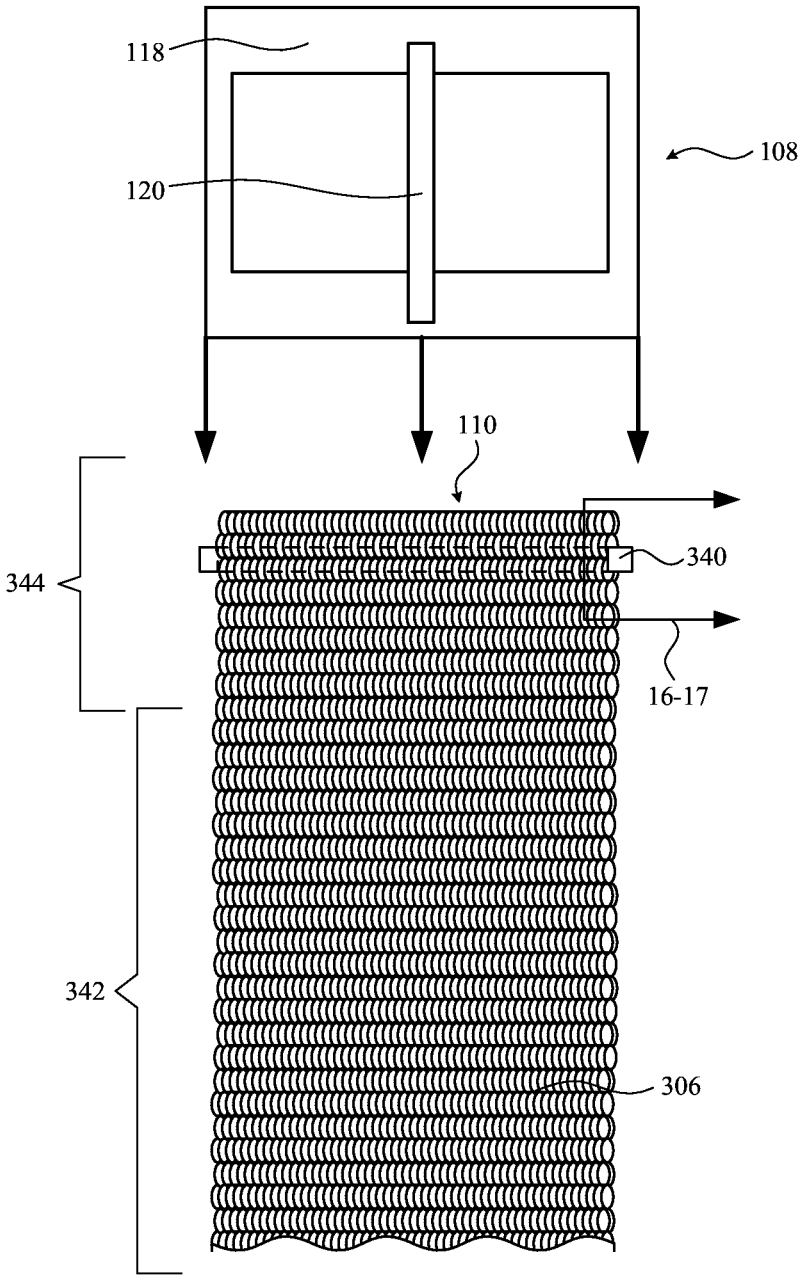
FIG. 14 depicts an illustrative enlarged front view of a woven material used to form an end of the wearable band of FIG. 1, according to embodiments.

FIG. 14 shows an enlarged front view of a portion of woven material 306 used to form the wearable band 100 of FIG. 1. The portion of woven material 306 shown in FIG. 14 may include woven material 306 prior to the inclusion or attachment of connection device 108, and ultimately the formation of wearable band 100 (see, e.g., FIG. 1). As indicated by arrows in FIG. 14, buckle 118 forming a portion of connection device 108 may be coupled to end 110 formed in woven material 306 via connection pin 340 (shown partially in phantom). Connection pin 340 may be positioned through and/or secured within woven material 306. In a non-limiting example, and discussed in detail herein, pin 340 may be positioned between two distinct layers (e.g., second layer (L2), third layer (L3)) of woven material 306 for coupling buckle 118 of connection device 108 to end 110 when forming wearable band 100.

As shown in FIG. 14, woven material 306 may include a textured pattern. As discussed herein, woven material 306 may be formed from a plurality of warp threads 330, at least one weft thread 332 (see, FIGS. 5-13) coupled to, woven, and/or interlaced between the plurality of warp threads, and a plurality of connecting yarns. As discussed herein, woven material 306 may be woven or manufactured to include a first section 342, and a second section 344 positioned adjacent first section 342, where first section 342 and second section 344 may include distinct configurations or weave patterns within woven material 306. First section 342 may include the majority of the body of wearable band 100 (see, FIG. 1) and may include a weave pattern substantially similar to any of the non-limiting examples shown in FIGS. 5-13.

Figure 15:
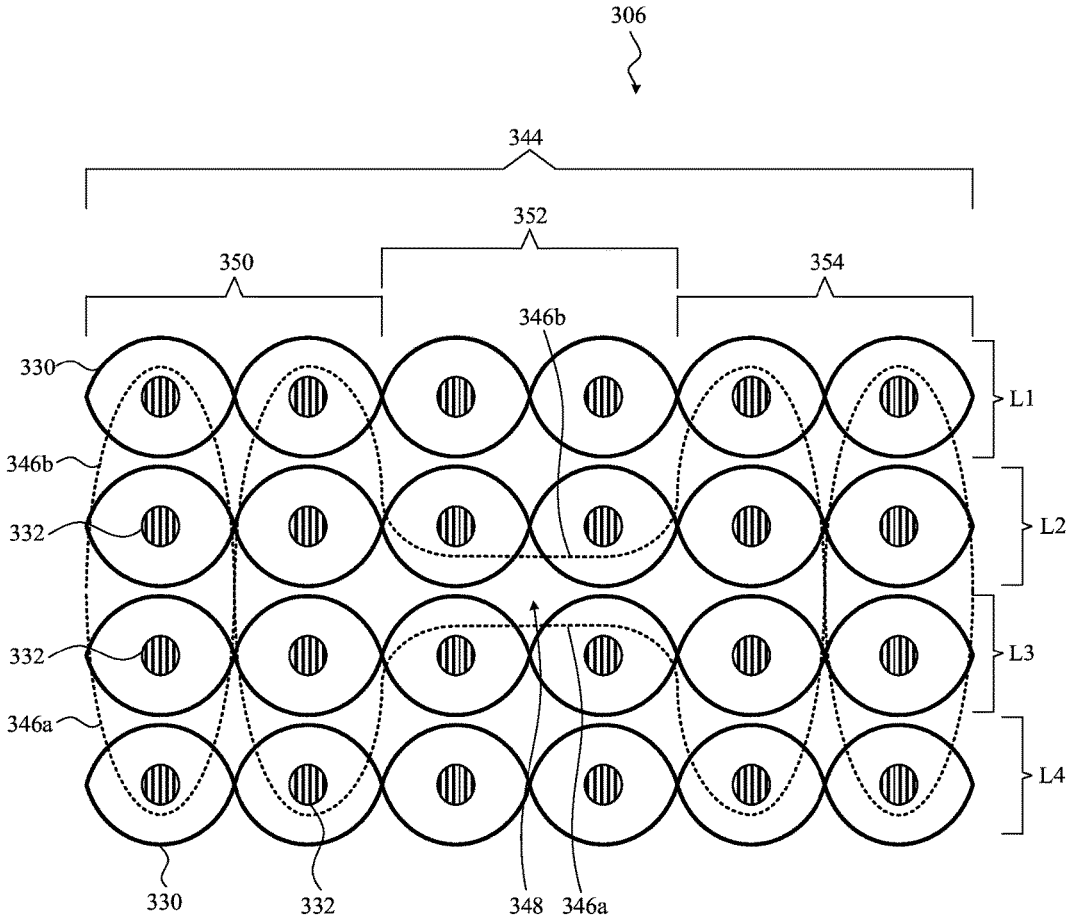
FIGS. 15 and 16 depict illustrative side cross-section views of the woven material having an altered weave pattern taken along line 15-16 of FIG. 14, according to various embodiments.

Second section 344 of woven material 306 may be positioned substantially adjacent end 110, and may include a distinct weave pattern from first section 342 for receiving pin 340 of connection device 108. Turning to FIG. 15, with continued reference to FIG. 14, a side cross-section view of second section 344 of woven material 306 taken along line 16-16 is shown. As shown in FIG. 15, the plurality of warp threads 330 and at least one weft thread 332 may be arranged in four distinct layers (L1-L4), as similarly discussed herein with respect to FIGS. 5-13. Redundant explanation of these components and/or features have been omitted for clarity.

Second portion 344 of woven material 306 may also include a single set of connection yarns 346*a*, 346*b*. Similar to connection yarns discussed herein with respect to FIGS. 5-13, single set of connection yarns 346*a*, 346*b* shown in FIG. 15 may be woven through weft thread 332 positioned between the plurality of warp threads 330 in distinct layers (L1-L4) of woven material 306 for coupling, binding and/or securing warp threads 330 and/or weft threads 332 of those layers together. However, distinct from the connection yarns discussed herein, single set of connection yarns 346*a*, 346*b* may alter its weave pattern over the length of woven material 306. The altering of the weave pattern of single set of connection yarns 346*a*, 346*b* may achieve a localized separation 348 in woven material 306, which may allow pin 340 (see, FIG. 14) to be inserted into woven material 306, as discussed herein.

As shown in the non-limiting example of FIG. 15, a first portion 350 of second section 344 in woven material 306 may include single set of connection yarns 346*a*, 346*b* woven through weft thread 332 positioned between the plurality of warp threads 330 in first layer (L1) and fourth layer (L4). As discussed herein, connection yarns 346*a*, 346*b* in first portion 350 may couple, bind and/or secure warp threads 330 and/or weft threads 332 of first layer (L1) and fourth layer (L4) together, as well as, secure and/or sandwich warp threads 330 and/or weft threads 332 of second layer (L2) and third layer (L3) between first layer (L1) and fourth layer (L4).

In a second portion 352 of second section 344 of woven material 306, the weave pattern of single set of connection yarns 346*a*, 346*b* may change. In second portion 352, as shown in FIG. 15, connection yarn 346*a* may not reach weft thread 332 positioned between warp threads 330 in fourth layer (L4) to continue the weave pattern achieved in first portion 350. Rather, connection yarn 346*a* may move toward and be woven around weft thread 332 positioned between warp threads 330 in second layer (L2) in second portion 352. Connection yarn 346*a* may be positioned between warp threads 330 in second layer (L2) and third layer (L3), and may run along a length of second portion 352 in second section 344 of woven material 306, without being woven through weft threads 332 positioned within second layer (L2). As a result, connection yarn 346*a*, as shown in FIG. 15, may pull warp threads 330 and/or weft threads 332 of second layer (L2) toward first layer (L1) of woven material 306.

Additionally, connection yarn 346*b* may not reach weft thread 332 positioned between warp threads 330 in first layer (L1) to continue the weave pattern achieved in first portion 350. Instead, connection yarn 346*b* may move toward and be woven around weft thread 332 positioned between warp threads 330 in third layer (L3) in second portion 352. In the non-limiting example, connection yarn 346*b* may be positioned between warp threads 330 in second layer (L2) and third layer (L3), and may run along a length of second portion 352 in second section 344 of woven material 306, parallel to connection yarn 346*a*, without being woven through weft threads 332 positioned within third layer (L3). As a result, connection yarn 346*b*, as shown in FIG. 15, may pull warp threads 330 and/or weft threads 332 of third layer (L3) toward fourth layer (L4) of woven material 306.

In third portion 354 in second section 344 of woven material 306, single set of connection yarns 346*a*, 346*b* may resume the weave pattern included in first portion 350. In the non-limiting example shown in FIG. 15, single set of connection yarns 346*a*, 346*b* may be woven through weft thread 332 positioned between the plurality of warp threads 330 in first layer (L1) and fourth layer (L4) in third portion 354.

The influence of connection yarn 346*a*, 346*b* on the inner layers (e.g., second layer (L2), third layer (L3)) of warp threads 330 and/or weft threads 332 may form localized separation 348 within second portion 352 in second section 344 of woven material 306. In the non-limiting example shown in FIG. 15, localized separation 348 formed between second layer (L2) and third layer (L3) may allow for woven material 306, and specifically warp threads 330 and weft threads 332, to be more easily separated to form a gap, space or opening between second layer (L2) and third layer (L3). As a result of forming localized separation 348 within woven material 306, pin 340 (see, FIG. 14) may be more easily inserted through and/or secured between second layer (L2) and third layer (L3) of warp threads 330 forming woven material 306.

Once localized separation 348 is formed in woven material 306, and pin 340 is inserted into localized separation 348, woven material 306 may undergo further processes before connecting connection device 108, and ultimately forming wearable band 100. As discussed in detail below, the additional processes may be performed on second section 344 of woven material 306 in order to couple connection device 108 to pin 340 and/or to improve the cosmetics of end 110 of wearable band 100 including connection device 108.

Figure 16:
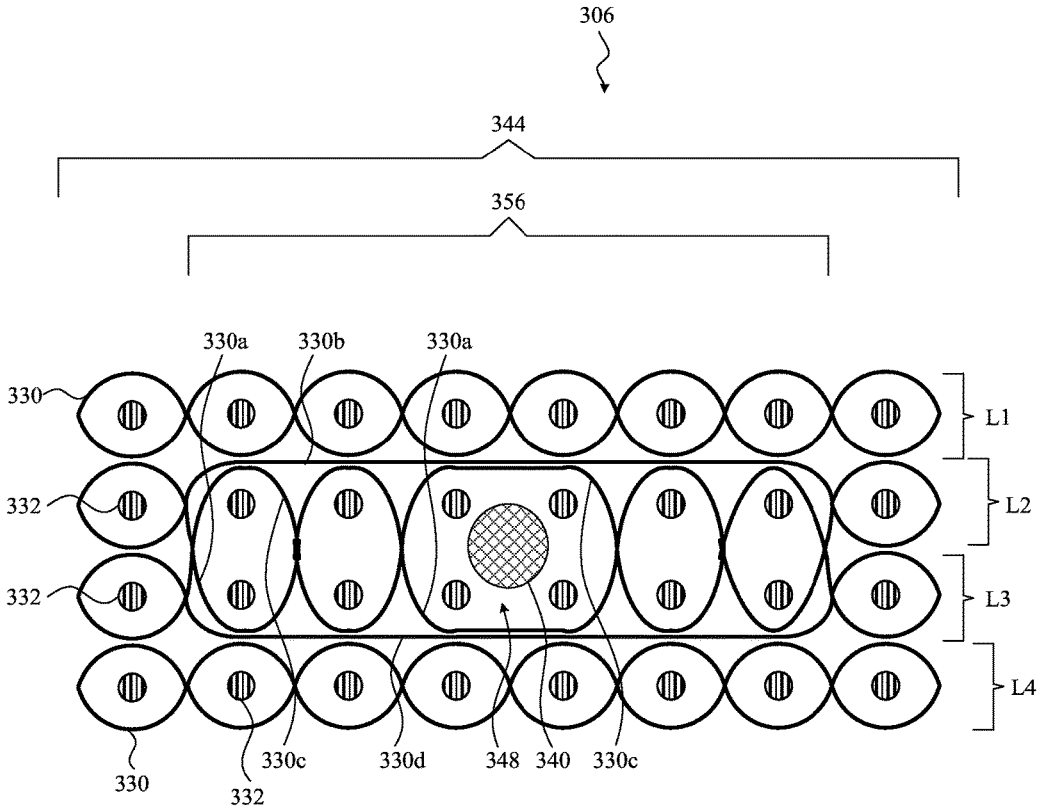

Localized separation 348 formed in second section 344 of woven material 306 may also be achieved by altering the weave pattern of the plurality of warp threads 330 used to form woven material 306. In a non-limiting example shown in FIG. 16, the weave pattern of warp threads 330*a*, 330*b* of second layer (L2), and warp threads 330*c*, 330*d* of third layer (L3) may be altered to form localized separation 348 in woven material 306. As shown in FIG. 16, localized separation 348 may be formed in an altered weave pattern portion 356 in second section 344 of woven material 306, and pin 340 may be inserted into localized separation 348.

In altered weave pattern portion 356, as shown in FIG. 16, warp thread 330*a* of second layer (L2) may be woven through weft thread 332 positioned between second layer (L2) and third layer (L3). Additionally, warp thread 330*b* of second layer (L2) may be positioned between weft thread 332 positioned within first layer (L1) and second layer (L2), and may run along the length of woven material 306 within altered weave pattern portion 356 without being woven around weft thread 332. Like warp thread 330*a*, warp thread 330*c* of third layer (L3) may be woven through weft thread 332 positioned between second layer (L2) and third layer (L3). Warp thread 330*a* of second layer (L2) and warp thread 330*c* of third layer (L3) may be woven within woven material 306 to couple, bind and/or secure second layer (L2) and third layer (L3). In the non-limiting example, warp thread 330*d* of third layer (L3) may be positioned between weft thread 332 positioned within third layer (L3) and fourth layer (L4). Warp thread 330*d* may run along the length of woven material 306 within altered weave pattern portion 356 without being woven around weft thread 332.

Localized separation 348 may be formed in altered weave pattern portion 356 in second section 344 of woven material 306 by allowing warp thread 330*a* of second layer (L2) and warp thread 330*c* of third layer (L3) to pass over at least one weft thread 332 in second layer (L2) and third layer (L3), respectively. In the non-limiting example shown in FIG. 16, the center of altered weave pattern portion 356 shows warp thread 330*a* of second layer (L2) and warp thread 330*c* of third layer (L3) temporarily discontinuing its weave pattern for a portion of the length of altered weave pattern portion 356. In this portion of altered weave pattern portion 356, warp thread 330*a* of second layer (L2) may be positioned above weft thread 332 positioned within second layer (L2), and may move along a length of woven material 306 between weft thread 332 in first layer (L1) and second layer (L2). Additionally in this portion of altered weave pattern portion 356, warp thread 330*c* of third layer (L3) may be positioned below weft thread 332 positioned within third layer (L3). In this portion, warp thread 330*c* of third layer (L3) may move along a length of woven material 306 between weft thread 332 in third layer (L3) and fourth layer (L4). This portion of temporary, discontinued weave pattern between warp thread 330*a* of second layer (L2) and warp thread 330*c* of third layer (L3) may form localized separation 348 in woven material 306.

Figure 17A:
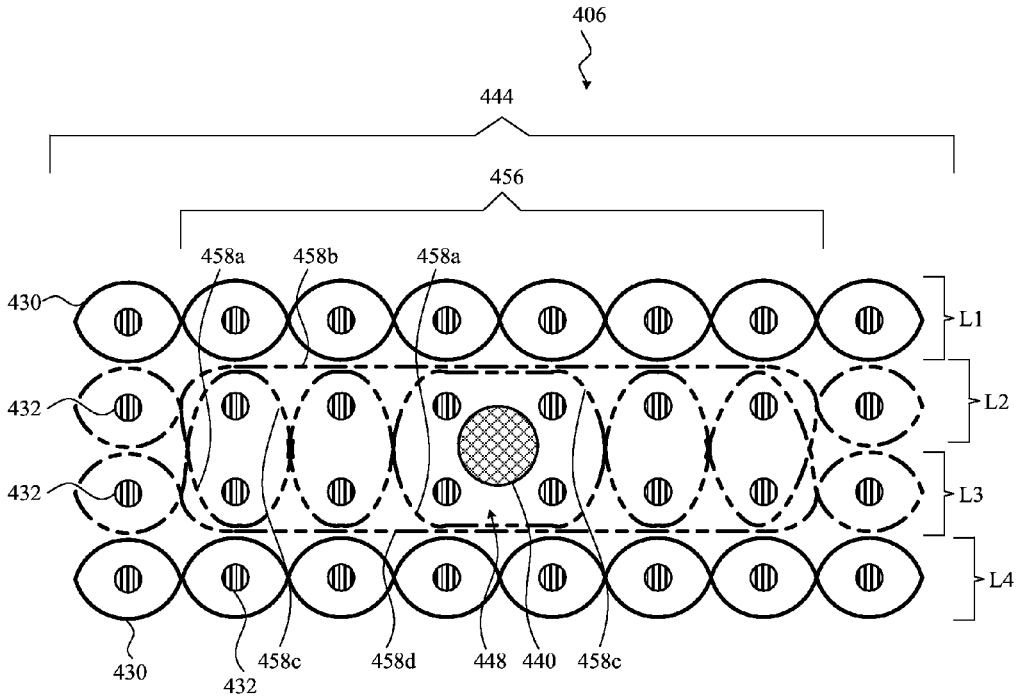
FIG. 17A depicts an illustrative side cross-section view of the woven material of FIG. 14 having an altered weave pattern before performing a melting process, according to embodiments.
Figure 17B:
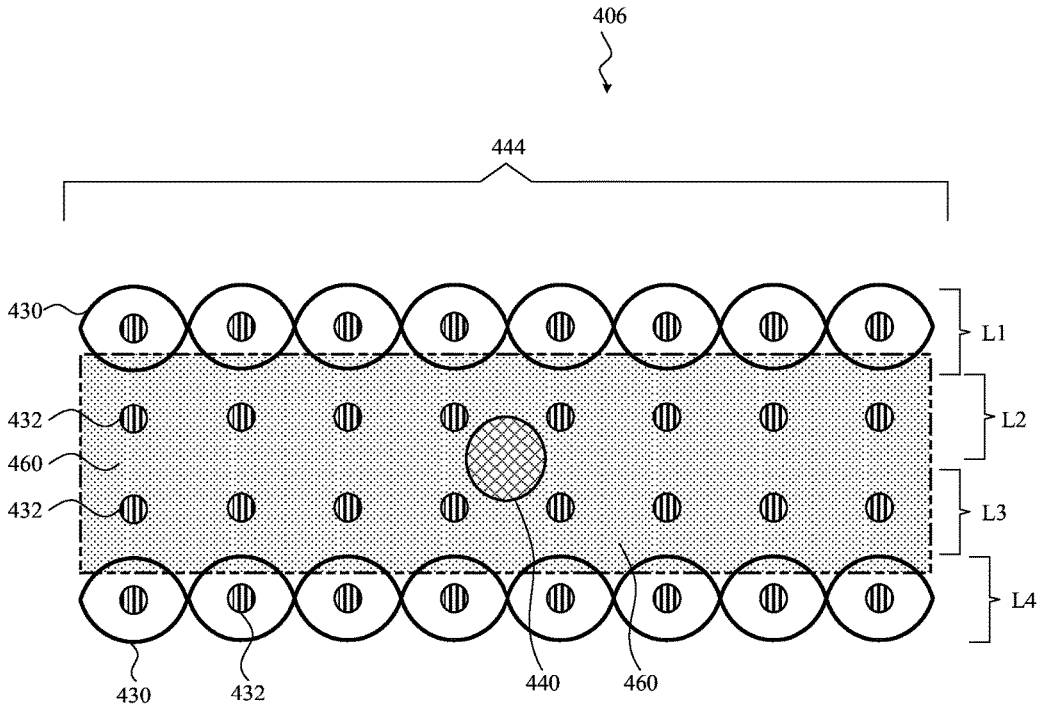
FIG. 17B depicts an illustrative side cross-section view of the woven material of FIG. 14 having an altered weave pattern after performing a melting process, according to embodiments.

FIGS. 17A and 17B show an additional, non-limiting embodiment of woven material 406 including localized separation 448. Woven material 406, as shown in FIGS. 17A and 17B, may include a similar weave pattern to that shown and discussed with respect to FIG. 16. However, distinct from the woven material shown in FIG. 16, woven material 406 of FIG. 17A may include distinct material used for warp threads 458*a*, 458*b*, 458*c*, 458*d*. In the non-limiting example, warp threads 458*a*, 458*b*, 458*c*, 458*d* used in forming second layer (L2) and third layer (L3) may include a distinct material from warp threads 430 used in forming first layer (L1) and fourth layer (L4). The material used in forming warp threads 458*a*, 458*b*, 458*c*, 458*d* of second layer (L2) and third layer (L3) may include a melting temperature substantially lower than the melting temperature of the material forming warp threads 430 of first layer (L1) and fourth layer (L4).

As a result, after pin 440 is inserted into localized separation 448 in woven material 406, woven material 406 may be substantially heated to the melting temperature of warp threads 458*a*, 458*b*, 458*c*, 458*d* forming second layer (L2) and third layer (L3). Warp threads 458*a*, 458*b*, 458*c*, 458*d* of second layer (L2) and third layer (L3) (see FIG. 17A) may substantially melt within woven material 406 to form a material melt region 460. The material melt region 460 formed by melted warp threads 458 second layer (L2) and third layer (L3) may be formed within woven material 406 without altering the physical appearance and/or characteristics of the rest of woven material 406. Additionally, material melt region 460 may provide rigidity to woven material 406 forming wearable band 100 (see, FIG. 1). Finally, and as shown in FIG. 17B, material melt region 460 may expand and/or contact unmelted warp threads 430 forming first layer (L1) and fourth layer (L4), and may couple, bind and/or secure first layer (L1) and fourth layer (L4) together, as similarly discussed herein with respect to the connection yarns included in woven material (see, FIGS. 5-13).

Although shown as a unitary layer or portion, it is understood that material melt region 460 may not expand as much as depicted in FIG. 17B. In an additional non-limiting example, each warp thread 458*a*, 458*b*, 458*c*, 458*d* melted to form material melt region 460 in woven material 406 may be melted to form two distinct material melt regions 460 that do not contact one another and/or do not contact adjacent first layer (L1) and/or fourth layer (L4) of warp threads 430 of woven material 406.

Although discussed herein as forming localized separation 348, 448 between second layer (L2) and third layer (L3) of woven material 306, 406, it is understood that localized separation 348, 448 may be formed between any two distinct layers (L1-L4) of woven material 306, 406.

Figure 18:
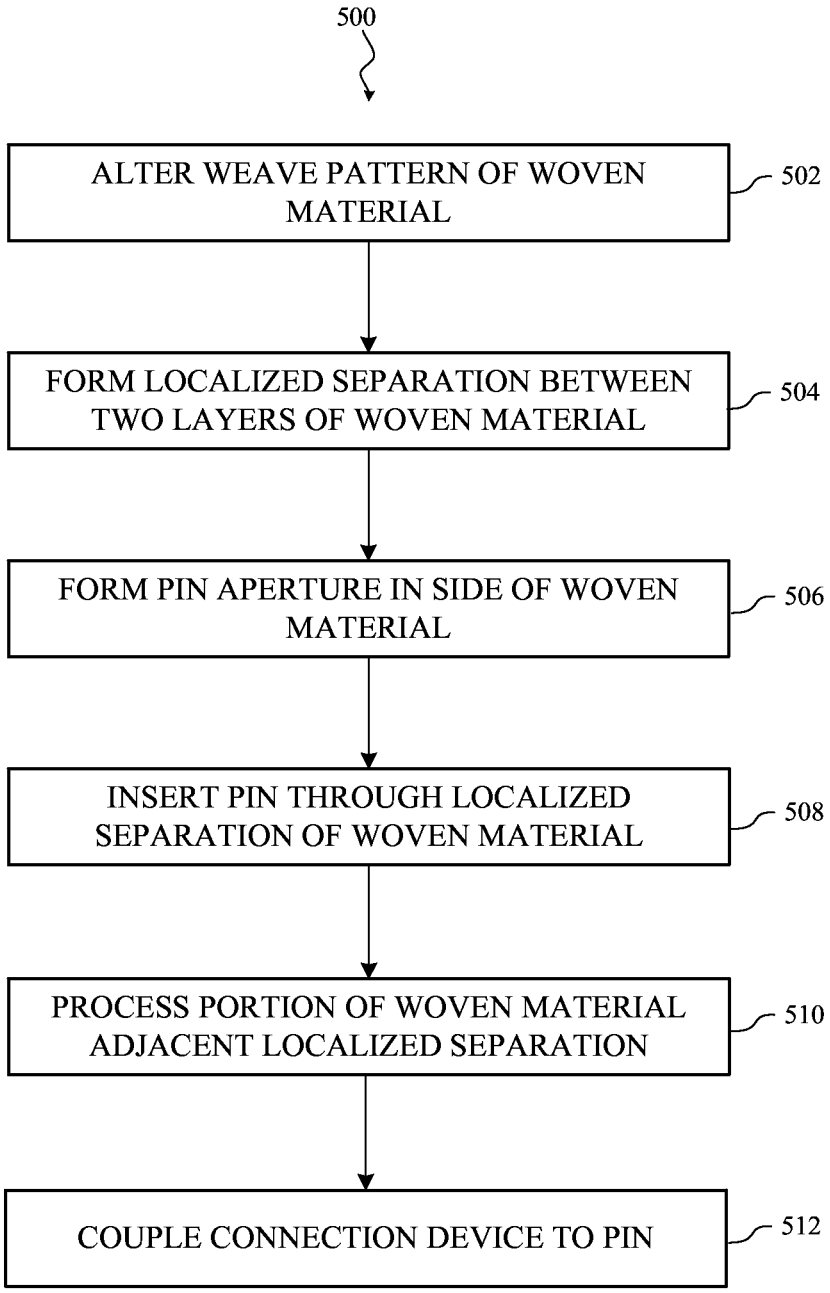
FIG. 18 depicts a flow chart of an example process for forming a wearable band assembly from a woven material, according to embodiments.

FIG. 18 depicts an example process for forming a wearable band for an electronic device. Specifically, FIG. 18 is a flowchart depicting one example process 500 for forming a wearable band from a woven material. In some cases, the process may be used to form the wearable band from woven material, as discussed above with respect to FIGS. 14-17B.

In operation 502, a weave pattern of a woven material may be altered. The woven material may include four distinct layers of a plurality of warp threads and at least one weft thread. The at least one weft thread may be coupled to, woven or interlaced between the plurality of warp threads in each of the four distinct layers. In a non-limiting example, each of the plurality of warp threads may alternate between being positioned above and below the weft thread, where at least one of the plurality of warp threads is positioned on an opposite side of the weft thread than a distinct warp thread. In the non-limiting example, woven material may include a connection yarn which may include an altered weave pattern for coupling, binding and/or securing layers of the woven material together. The altered weave pattern of the connection yarn may enable the first layer and the second layer to being bound, and distinctly, the third layer and the fourth layer to being bound.

In an additional, non-limiting example, the weave pattern for the plurality of warp threads in the second layer and the third layer may be altered. In the additional, non-limiting example, a warp thread of the second layer and a warp thread of the third layer are woven between the second layer and the third layer over a portion of the length of the woven material.

In operation 504, a localized separation between two distinct layers of the four distinct layers of the woven material may be formed. The localized separation formed between the two distinct layers of the woven material may receive a pin for coupling a connection device to the woven material. The forming of the localized separation in the woven material may be achieved using the altered weave pattern of the connection yarn and/or the warp threads in the woven material. The connection yarns and/or warp threads, including the altered weave pattern, may secure two adjacent layers of the four layers of woven material, creating a spacing between each of the pair of adjacent layers secured together.

In operation 506, a pin aperture may be formed in the side of the woven material. The pin aperture may be formed inside of the woven material, adjacent the localized separation formed in operation 504. Specifically, the pin aperture may be formed on the side of woven material, and may be aligned with the localized separation. The forming of the pin aperture may further include creating an opening through the woven material, including the localized separation, for receiving the pin.

In operation 508, a pin may be inserted through the localized separation formed in the woven material. The pin may be inserted through the pin aperture, and completely though the woven material via the localized separation. The inserting of the pin through the localized separation may also include securing the pin within the localized separation between two distinct layers of the woven material.

In operation 510, a portion of the woven material positioned adjacent the localized separation and pin may be processed. The processing of the portion of the woven material positioned adjacent the localized separation may transform woven material into a wearable band for an electronic device. The processing of the portion of the woven material positioned adjacent the localized separation may further include hot pressing the portion of the woven material, pinching the portion of the woven material and/or laser cutting the portion of the woven material. Additionally, the laser cut portion of the woven material positioned adjacent the localized separation may undergo further processes including sanding of the laser cut portion of the woven material, debos sing the laser cut portion of the woven material, and/or melting the laser cut portion of the woven material.

Finally, in operation 512, a connection device may be coupled to the pin inserted through the localized separation formed between the two distinct layers of the woven material. The connection device may be coupled to the pin after the portion of the woven material positioned adjacent the localized separation is processed, or in an alternative, operation 510 may be omitted, and the connection device may be coupled to the pin after insertion of the pin through the localized separation in the woven material (e.g., operation 508). The coupling of the connection device to the pin may form the wearable band to be utilized with a wearable electronic device.

Figure 19:
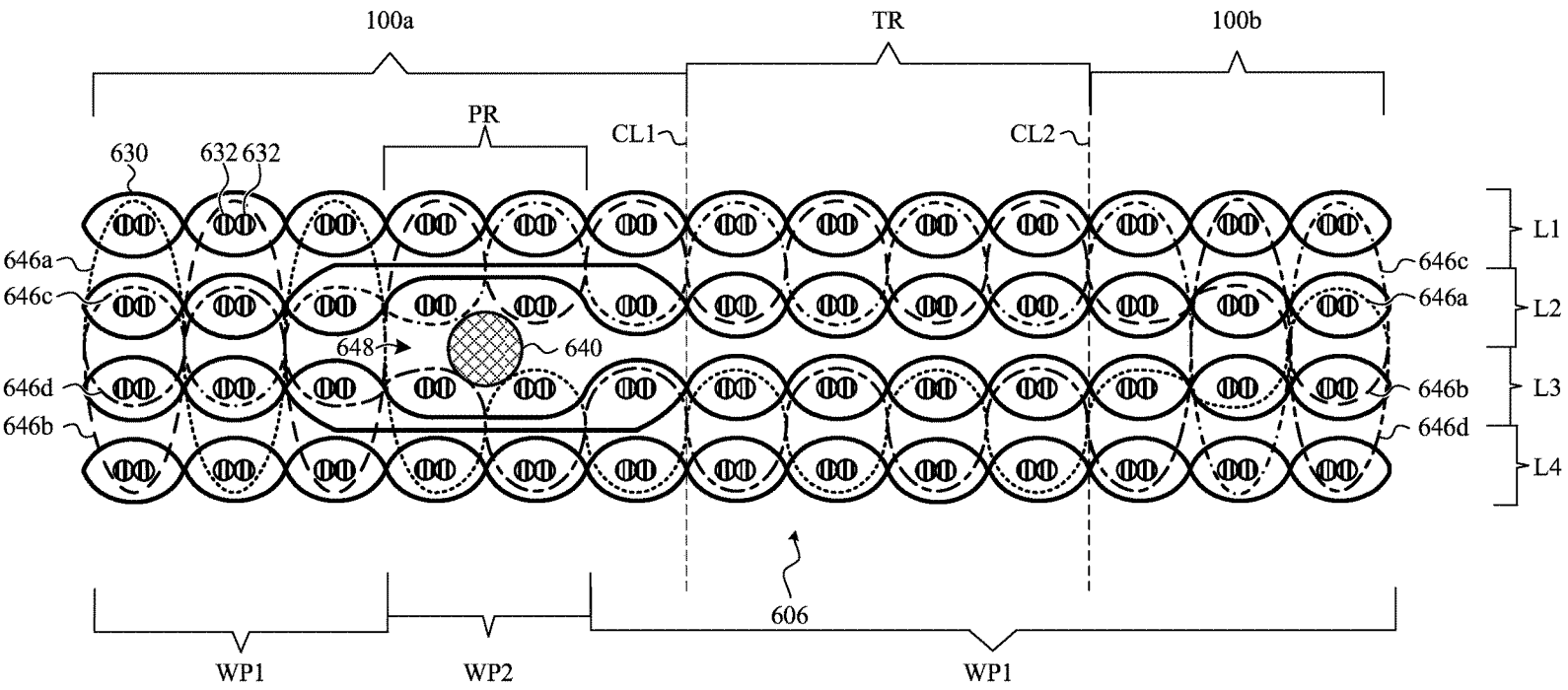
FIG. 19 depicts an illustrative side cross-section view of a woven material having an altered weave pattern used to form multiple wearable bands, according to various embodiments.

FIG. 19 shows a cross-section side view of woven material 606 used to form multiple wearable bands 100 of FIG. 1 from a single piece of woven material 606. In the non-limiting example shown in FIG. 19, woven material 606 may show the end or completion of a first wearable band 100*a* and the beginning or start of a second wearable band 100*b*. First wearable band 100*a* may end and/or be cut along a first cut line (CL1) adjacent a pin region (PR). Pin region (PR) may represent the portion of woven material 606 that may include localized separation 648 and/or connection pin 640 positioned within localized separation 648 to couple connection device 108 to end 110 of woven material 606, as similarly discussed with respect to FIGS. 14-18.

Additionally as shown in FIG. 19, woven material 606 may also include a transition region (TR) formed between first wearable band 100*a* and second wearable band 100*b*. In the non-limiting example, transition region (TR) may be formed after the first cut line (CL1) forming first wearable band 100*a*, and before the weave pattern for the warp threads 630, weft threads 632 and/or connection yarns 646 are altered and/or changed, as discussed in detail herein. Transition region (TR) may undergo various processes prior to being removed from woven material 606, and ultimately forming first wearable band 100*a* and second wearable band 100*b*. In non-limiting examples, woven material 606 in transition region (TR) may be melted and/or pinched, as similarly discussed herein with respect to FIGS. 3-5. The melting and/or pinching of transition region (TR) may take place prior to or after cutting woven material 606 along first cut line (CL1) to form first wearable band 100*a*. As discussed herein, melting and/or pinching woven material 606 may provide woven material 606 with a reduced thickness and/or may have a desirable cosmetic appearance by reducing fraying and/or preventing unwoven threads when forming ends for first wearable band 100*a* and second wearable band 100*b*. After woven material 606 formed in transition region (TR) is melted and/or pinched, transition region of woven material 606 may be cut adjacent second wearable band 100*b*, along second cut line (CL2).

As shown in FIG. 19, the weave pattern of woven material 606 may be altered to form first wearable band 100*a* and second wearable band 100*b* from a single piece of woven material 606, and also to form localized separation 648 for receiving connection pin 640. As discussed in detail below, the weave pattern may be altered for warp threads 630, and/or the various connection yarns 646 forming woven material 606.

A portion of warp threads 630 may have a constant weave pattern, and the remaining portion of warp threads 630 may have an altered weave pattern when forming first wearable band 100*a* and second wearable band 100*b* from woven material 606. In a non-limiting example shown in FIG. 19, warp threads 630 forming first layer (L1) and fourth layer (L4) of the plurality of warp threads 630 may have a weave pattern that may be constant and/or may not be altered when forming first wearable band 100*a* and second wearable band 100*b*. In the non-limiting example, and as similarly discussed herein with respect to FIG. 5, warp threads 630 of first layer (L1) and fourth layer (L4) may alternate between being positioned above and below weft thread 632.

Warp threads 630 of second layer (L2) and third layer (L3) may have an altered weave pattern in woven material 606. In the non-limiting example shown in FIG. 19, warp threads 630 of second layer (L2) and third layer (L3) may have a similar weave pattern to warp threads 630 of first layer (L1) and fourth layer (L4) in the portions of woven material 606 surrounding pin region (PR) (e.g., first wearable band 100*a*, transition region (TR), second wearable band 100*b*). However, in pin region (PR) of woven material 606, the weave pattern of warp threads 630 in second layer (L2) and third layer (L3) may be substantially altered. As shown in FIG. 19, both warp threads 630 of second layer (L2) may be positioned above the weft threads 632 of second layer (L2) and/or may be positioned between weft threads 632 formed in first layer (L1) and second layer (L2). Additionally, both warp threads 630 of third layer (L3) may be positioned below the weft threads 632 of third layer (L3) and/or may be positioned between weft threads 632 formed in third layer (L3) and fourth layer (L4). As shown in FIG. 19, no warp threads 630 may separate and/or be positioned between the weft threads 632 formed in second layer (L2) and third layer (L3) in pin region (PR) of woven material 606. As a result of warp threads 630 altered weave pattern in pin region (PR), and because of the weave pattern of connection yarns 646 discussed in detail below, localized separation 648 may be formed between second layer (L2) and third layer (L3) of warp threads 630 for receiving connection pin 640.

As shown in FIG. 19, woven material 606 may have four distinct connection yarns 646*a*, 646*b*, 646*c*, 646*d* utilized to form first wearable band 100*a* and second wearable band 100*b*. Depending on the region (e.g., wearable band 100, pin region (PR), transition region (TR)) of woven material 606, connection yarns 646*a*, 646*b*, 646*c*, 646*d* may have a unique or altered weave pattern. In the non-limiting example, first connection yarn 646*a* and second connection yarn 646*b* may be woven through weft threads 632 positioned between first layer (L1) and the fourth layer (L4) of warp threads 630 in the portion of first wearable band 100*a* positioned adjacent pin region (PR). First connection yarn 646*a* and second connection yarn 646*b* may be alternately woven, such that when first connection yarn 646*a* is woven around weft thread 632 in first layer (L1), second connection yarn 646*b* is woven around weft thread 632 in fourth layer (L4), and vice versa.

At pin region (PR) however, the weave pattern of first connection yarn 646*a* and second connection yarn 646*b* may be altered. In the non-limiting example shown in FIG. 19, first connection yarn 646*a*, beginning in pin region (PR), may be woven through weft threads 632 positioned between third layer (L3) and fourth layer (L4) of warp threads 630. As a result, first connection yarn 646*a* may not pass between second layer (L2) and third layer (L3) of warp threads 630 in pin region (PR) and/or may not pass through localized separation 648 formed in woven material 606. Additionally, in the non-limiting example shown in FIG. 19, second connection yarn 646*b*, beginning in pin region (PR), may be woven through weft threads 632 positioned between first layer (L1) and second layer (L2) of warp threads 630. Similar to first connection yarn 646*a*, second connection yarn 646*b* may not pass between second layer (L2) and third layer (L3) of warp threads 630 in pin region (PR) and/or may not pass through localized separation 648 formed in woven material 606. The altered weave pattern for first connection yarn 646*a* and second connection yarn 646*b* may be maintained through pin region (PR) and transition region (TR) of woven material 606, as shown in FIG. 19.

At the end of transition region (TR), and/or the beginning of second wearable band 100*b*, the weave pattern of first connection yarn 646*a* and second connection yarn 646*b* may be altered again. In the non-limiting example shown in FIG. 19, first connection yarn 646*a*, beginning at second cut line (CL2) or second wearable band 100*b*, may be woven through weft threads 632 positioned between second layer (L2) and third layer (L3) of warp threads 630. Additionally, in the non-limiting example shown in FIG. 19, second connection yarn 646*b*, beginning at second cut line (CL2) or second wearable band 100*b*, may also be woven through weft threads 632 positioned between second layer (L2) and third layer (L3) of warp threads 630, opposite first connection yarn 646*a*. By comparison, first connection yarn 646*a* and second connection yarn 646*b* may connect outer layers (e.g., first layer (L1), fourth layer (L4)) in first wearable band 100*a*, and connect inner layers (e.g., second layer (L2), third layer (L3)) in second wearable band 100*b* as a result of the unique or altered weave pattern in woven material 606.

Third connection yarn 646*c* and fourth connection yarn 646*d* may also have altered weave patterns in woven material 606. In the non-limiting example shown in FIG. 19, third connection yarn 646*c* and fourth connection yarn 646*d* may be woven through weft threads 632 positioned between second layer (L2) and third layer (L3) of warp threads 630 in the portion of first wearable band 100*a* positioned adjacent pin region (PR). Third connection yarn 646*c* and fourth connection yarn 646*d* may be alternately woven, such that when third connection yarn 646*c* is woven around weft thread 632 in second layer (L2), fourth connection yarn 646*d* is woven around weft thread 632 in third layer (L3), and vice versa.

At pin region (PR) however, the weave pattern of third connection yarn 646*c* and fourth connection yarn 646*d* may be altered. In the non-limiting example shown in FIG. 19, third connection yarn 646*c*, beginning in pin region (PR), may be woven through weft threads 632 positioned between first layer (L1) and second layer (L2) of warp threads 630. As a result, and similar to first connection yarn 646*a* and second connection yarn 646*b*, third connection yarn 646*c* may not pass between second layer (L2) and third layer (L3) of warp threads 630 in pin region (PR) and/or may not pass through localized separation 648 formed in woven material 606. Additionally, in the non-limiting example shown in FIG. 19, fourth connection yarn 646*d*, beginning in pin region (PR), may be woven through weft threads 632 positioned between third layer (L3) and fourth layer (L4) of warp threads 630. Similar to third connection yarn 646*c*, fourth connection yarn 646*d* may not pass between second layer (L2) and third layer (L3) of warp threads 630 in pin region (PR) and/or may not pass through localized separation 648 formed in woven material 606. The altered weave pattern for third connection yarn 646*c* and fourth connection yarn 646*d* may be maintained through pin region (PR) and transition region (TR) of woven material 606, as shown in FIG. 19.

At the end of transition region (TR), and/or the beginning of second wearable band 100*b*, the weave pattern of third connection yarn 646*c* and fourth connection yarn 646*d* may be altered again. In the non-limiting example shown in FIG. 19, third connection yarn 646*c*, beginning at second cut line (CL2) or second wearable band 100*b*, may be woven through weft threads 632 positioned between first layer (L1) and fourth layer (L4) of warp threads 630. Additionally, in the non-limiting example shown in FIG. 19, fourth connection yarn 646*d*, beginning at second cut line (CL2) or second wearable band 100*b*, may also be woven through weft threads 632 positioned between first layer (L1) and fourth layer (L4) of warp threads 630, opposite third connection yarn 646*c*. By comparison, third connection yarn 646*c* and fourth connection yarn 646*d* may connect inner layers (e.g., second layer (L2), third layer (L3)) in first wearable band 100*a*, and connect outer layers (e.g., first layer (L1), fourth layer (L4)) in second wearable band 100*b* as a result of the unique or altered weave pattern in woven material 606. This may be the opposite to the connections formed using first connection yarn 646*a* and second connection yarn 646*b* in first wearable band 100*a* and second wearable band 100*b*, respectively.

As shown in FIG. 19, weft threads 632 may also include a unique and/or altered weave pattern when forming first wearable band 100*a* and second wearable band 100*b* from woven material 606. In the non-limiting example, and distinct from woven material 306 discussed herein with respect to FIGS. 15 and 16, woven material 606 may include weft thread 632 passing through each layer of warp threads 630 twice between every transition of warp threads 630. As shown in FIG. 19, each of the four distinct layers (L1-L4) of the plurality of warp threads 630 may have warp thread 632 pass between the warp threads twice, before warp threads 630 alternate positions (e.g., above, below) with respect to weft thread 632.

The weave pattern of weft threads 632 may also be altered dependent on the region (e.g., wearable band 100, pin region (PR), transition region (TR)) of woven material 606. As shown in FIG. 19, weft thread 632 may be formed within woven material 606 by a first weave pattern (WP1) in the portion of first wearable band 100*a* positioned adjacent pin region (PR), in transition region (TR) and/or in second wearable band 100*b*. In pin region (PR) however, weft thread 632 may be formed in woven material 606 by a second weave pattern (WP2). Second weave pattern (WP2) of weft thread 632 in pin region (PR) may ease the initial insertion of pin 340 of connection device 108 (see, FIG. 14) through localized separation 648 in woven material 606 and/or may allow a portion of pin 340 to more easily exit woven material 606 prior to coupling connection device 108 to pin 340. Additionally, and as discussed herein, localized separation 648 formed in woven material 606 may be more easily accessed in portions of woven material 606 having weft threads 632 woven using second weave pattern (WP2).

Figure 20:
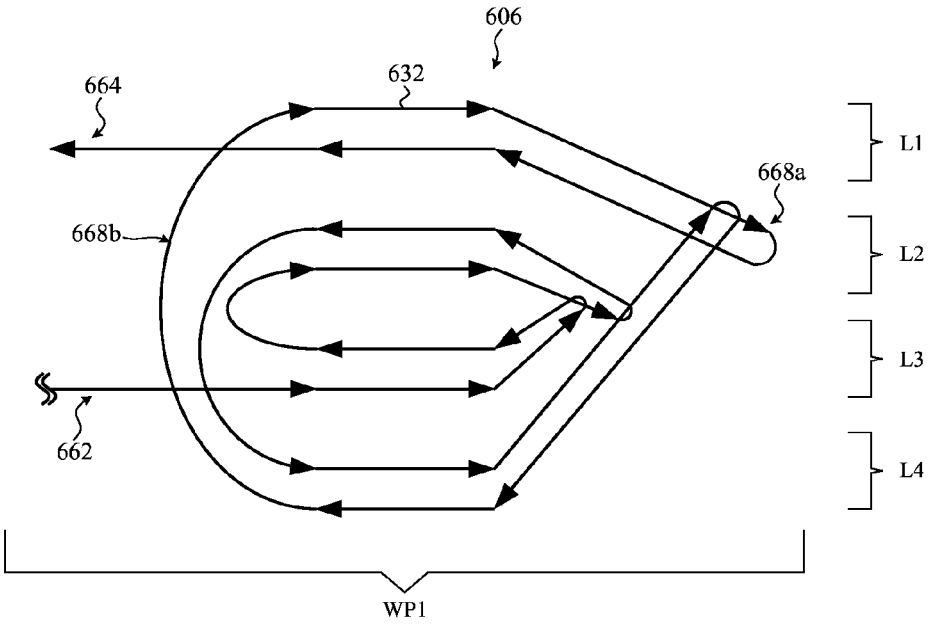
FIG. 20 depicts an illustrative front view of a weft thread of the woven material of FIG. 19 woven using a first weave pattern, according to embodiments.
Figure 21:
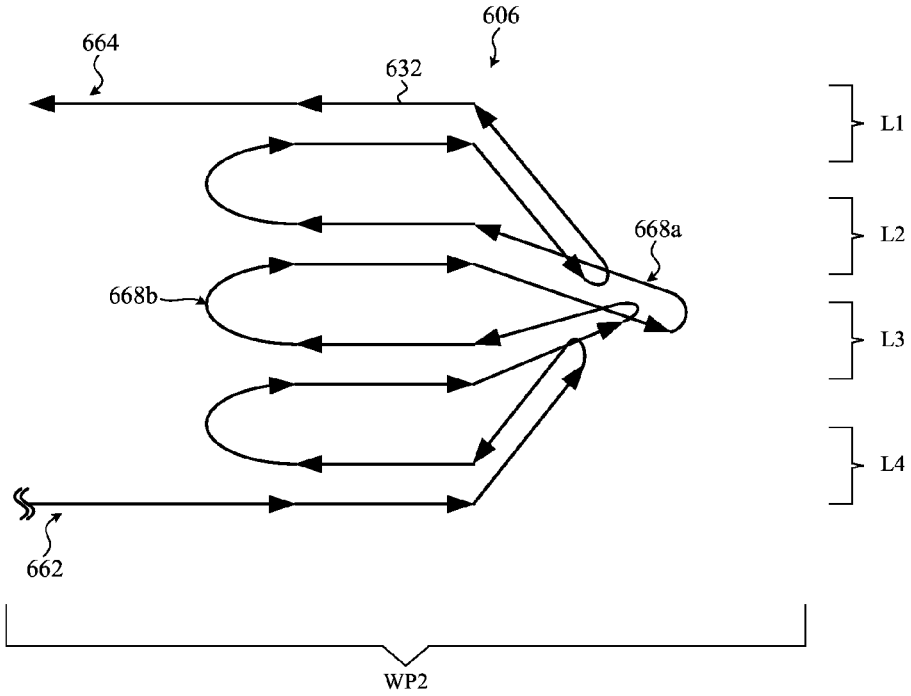
FIG. 21 depicts an illustrative front view of a weft thread of the woven material of FIG. 19 woven using a second weave pattern, according to embodiments.

Turning to FIGS. 20 and 21, and with continued reference to FIG. 19, first weave pattern (WP1) and second weave pattern (WP2) of weft thread 632 of woven material 606 are shown. The arrows depicted in FIGS. 20 and 21 may represent weft thread 632, and may also indicate the direction and/or order in which weft thread 632 is woven within woven material 606. Warp threads 630 may be omitted for clarity from FIGS. 20 and 21. However, it is understood that the plurality of warp threads 630 formed in the four distinct layers (L1-L4) may alternate between being positioned above and below the two distinct passes of weft thread 632 in each of the layers (L1-L4), as discussed herein. Additionally, it is understood that weft thread 632 shown in FIGS. 20 and 21 may be woven much tighter than depicted, and the weave patterns for weft thread 632 shown in FIGS. 20 and 21 may be spread out and/or distanced for clarity and exemplary purposes.

As discussed herein, weft thread 632 may be formed from a single piece of thread that may be interwoven through all layers (L1-L4) of warp threads, along the entire length of woven material 606. In the non-limiting examples shown in FIGS. 20 and 21, weft thread 632 of woven material 606 may have incoming thread portions 662 and outgoing thread portion 664. Incoming thread portions 662 may be weft thread 632 that was previously woven through the four distinct layers (L1-L4) of warp threads 630 positioned adjacent the portion to be woven by weft thread 632. Additionally, outgoing thread portion 664 may be weft thread 632 that may be woven through subsequent portions of the four distinct layers (L1-L4) of warp threads 630 forming woven material 606.

Additionally, FIGS. 20 and 21 show material sides 668*a*, 668*b* for woven material 606. Material sides 668*a*, 668*b* of woven material 606 may determine the width of wearable band 100 (see, FIG. 1) formed from woven material 606. As similarly discussed herein, it is understood that the dimensions and/or spacing of material sides 668*a*, 668*b* of woven material 606, as shown in FIGS. 20 and 21, may be merely exemplary, and may not necessarily represent the distance between weft thread 632 as it is woven through woven material 606.

FIG. 20 shows first weave pattern (WP1) for weft thread 632 of woven material 606. In first weave pattern (WP1), weft thread 632 may continuously move between material side 668*a* and material side 668*b* of woven material 606 and may pass through the four distinct layers (L1-L4) of warp threads 630. In the non-limiting example shown in FIG. 20, incoming thread portion 662 of weft thread 632 may first enter in third layer (L3) of warp threads 630. From there, weft thread 632 may be woven, in order, through third layer (L3) of warp threads 630, second layer (L2) of warp threads 630, fourth layer (L4) of warp threads 630 and finally, first layer (L1) of warp threads 630, as shown in FIG. 20. From first layer (L1) of warp threads 630, outgoing thread portion 664 of weft thread 632 may be woven through a subsequent portion of warp threads 630 of woven material 606.

As shown in FIG. 20, weft thread 632 may be woven through itself on material side 668*a*, such that the portions of weft thread 632 in the four distinct layers (L1-L4) of warp threads 630 may be intertwined and/or interwoven. Additionally, weft thread 632 may loop between distinct layers of warp threads 630 on material side 668*b* as it is woven using first weave pattern (WP1). As weft thread 632 loops between distinct layers (L1-L4) of warp threads 630 of woven material 606, portions of weft thread 632 on material side 668*b* may also overlap weft thread 632 in distinct layers. In a non-limiting example shown in FIG. 20, the portion of weft thread 632 looping from second layer (L2) to fourth layer (L4) on material side 668*b* may overlap weft thread 632 positioned in second layer (L2) and third layer (L3). In another non-limiting example shown in FIG. 20, the portion of weft thread 632 looping from fourth layer (L4) to first layer (L1) on material side 668*b* may overlap weft thread 632 positioned in second layer (L2), third layer (L3) and fourth layer (L4).

FIG. 21 shows second weave pattern (WP2) for weft thread 632 of woven material 606. Similar to weft thread 632 in first weave pattern (WP1), weft thread 632 in second weave pattern (WP2) may continuously move between material side 668*a* and material side 668*b* of woven material 606 and may pass through the four distinct layers (L1-4) of warp threads 630. In the non-limiting example shown in FIG. 21, incoming thread portion 662 of weft thread 632 may first enter in fourth layer (L4) of warp threads 630. From there, weft thread 632 may be woven, in order, through fourth layer (L4) of warp threads 630, third layer (L3) of warp threads 630, second layer (L2) of warp threads 630 and finally, first layer (L1) of warp threads 630, as shown in FIG. 21. From first layer (L1) of warp threads 630, outgoing thread portion 664 of weft thread 632 may be woven through a subsequent portion of warp threads 630 of woven material 606.

As similarly discussed herein with respect to FIG. 20, weft thread 632 may be woven through, interwoven and/or interlace distinct layers of warp threads 630 on material side 668*a*. Additionally, as shown in FIG. 21, and similar to FIG. 20, weft thread 632 may be looped between distinct layers (L1-4) of warp threads 630 on material side 668*b*. However, distinct from first weave pattern (WP1), no portion of weft thread 632 may overlap another distinct layer of weft thread 632 in second weave pattern (WP2). Because weft thread 632 does not overlap when woven using second weave pattern (WP2), each of the four distinct layers (L1-L4) of warp threads 630 may be more easily separated then the four distinct layers (L1-L4) of warp threads 630 having weft thread 632 woven using first weave pattern (WP1). As a result, pin region (PR), which may have weft thread 632 woven using second weave pattern (WP2), may allow for easier access to and/or easier penetration of pin 340 in/out of localized separation 648 formed in woven material 606.

The weave pattern of a woven material may be altered to provide a locally thinned portion in the woven material to improve the melting and/or pinching process performed on the woven material. Additionally, the locally thinned portion of the woven material may provide better cosmetic features and/or appearance of the melted/pinched woven material when the woven material is utilized in a wearable band for an electronic device. Additionally, the altering of the weave pattern of the woven material may increase flexibility in the woven material and/or reduce stiffness. Also, the weave pattern of the woven material may be altered to create a localized separation between the plurality of layers forming the woven material. This localized separation may allow components of the wearable band to be more easily inserted through and/or secured within the woven material used to form the wearable band of the electronic device. The altering of the weave pattern may be achieved by altering a weave pattern of the plurality of warp threads of the woven material, and/or at least one connection yarn woven through the woven material.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

We claim:

1. A watchband comprising:

a first portion comprising a weave pattern formed by warp threads and at least one weft thread woven between the warp threads and in which adjacent first passes of the at least one weft thread are separated from each other by a first distance; and a locally thinned portion positioned adjacent the first portion, the locally thinned portion comprising an altered weave pattern formed by woven material comprising the warp threads and the at least one weft thread and in which adjacent second passes of the at least one weft thread are separated from each other by a second distance, the second distance being greater than the first distance, wherein the locally thinned portion has an average thickness between the adjacent second passes of the at least one weft thread that is smaller than an average thickness between the adjacent first passes of the at least one weft thread in the first portion, and the locally thinned portion defines a melt region in which the woven material is fused together, and the first portion is outside the melt region such that the warp threads and the at least one weft thread are not fused together in the first portion.

2. The watchband of claim 1, wherein the locally thinned portion extends over a predetermined portion of a length of the watchband.

3. The watchband of claim 1, wherein the first portion has a first thickness and the locally thinned portion comprises a second thickness smaller than the first thickness of the first portion.

4. The watchband of claim 1, wherein the warp threads alternate between being positioned above and below the at least one weft thread in the first portion and the locally thinned portion.

5. The watchband of claim 3, further comprising a distinct portion positioned opposite the first portion, and separated from the first portion by the locally thinned portion, the distinct portion having the first thickness.

6. The watchband of claim 1, wherein:

the first portion and the locally thinned portion are along a first band portion comprising an end configured to couple to a housing of a watch; and the watchband further comprises:

a second band portion comprising:

a first end comprising a connection device configured to couple to the first band portion; and a second end configured to couple to the housing of the watch.

7. A watchband comprising:

woven material comprising warp threads and a weft thread that form:

a first portion in which at least some of the warp threads and the weft thread are woven together and in which adjacent first passes of the weft thread are separated from each other by a first distance; and a second portion defining a melt region in which the woven material is fused together only in the second portion and in which adjacent second passes of the weft thread are separated from each other by a second distance greater than the first distance, the second portion having an average thickness that is smaller than an average thickness of the first portion, wherein the first portion is outside the melt region.

8. The watchband of claim 7, wherein the second portion extends over a predetermined portion of a length of the watchband.

9. The watchband of claim 7, wherein the warp threads alternate between being positioned above and below the weft thread in the first portion and the second portion.

10. The watchband of claim 7, further comprising a third portion positioned opposite the first portion, and separated from the first portion by the second portion, the third portion having a thickness equal to a thickness of the first portion.

11. The watchband of claim 7, wherein:

the first portion and the second portion are along a first band portion comprising an end configured to couple to a housing of a watch; and the watchband further comprises:

a second band portion comprising:

a first end comprising a connection device configured to couple to the first band portion; and a second end configured to couple to the housing of the watch.

12. A watchband comprising:

woven material comprising warp threads and weft threads that form:

a first portion in which at least some of the warp threads and at least some of the weft threads are woven together and in which adjacent passes of the weft threads are separated from each other by a first distance; and a second portion defining a melt region in which the woven material is fused together only in the second portion and in which adjacent passes of the weft threads are separated from each other by a second distance greater than the first distance, the second portion having an average thickness that is smaller than an average thickness of the first portion, wherein the first portion is outside the melt region.

13. The watchband of claim 12, wherein the second portion extends over a predetermined portion of a length of the watchband.

14. The watchband of claim 12, wherein the warp threads alternate between being positioned above and below the weft threads in the first portion and the second portion.

15. The watchband of claim 12, further comprising a third portion positioned opposite the first portion, and separated from the first portion by the second portion, the third portion having a thickness equal to a thickness of the first portion.

16. The watchband of claim 12, wherein:

the first portion and the second portion are along a first band portion comprising an end configured to couple to a housing of a watch; and the watchband further comprises:

a second band portion comprising:

a first end comprising a connection device configured to couple to the first band portion; and a second end configured to couple to the housing of the watch.

* * * * *